US007637591B2

(12) United States Patent
Takahashi et al.

(10) Patent No.: US 7,637,591 B2
(45) Date of Patent: Dec. 29, 2009

(54) INKJET HEAD, INKJET RECORDING APPARATUS AND METHOD OF FORMING DOT PATTERN

(75) Inventors: Yoshikazu Takahashi, Nagoya (JP); Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 541 days.

(21) Appl. No.: 11/535,959

(22) Filed: Sep. 27, 2006

(65) Prior Publication Data

US 2007/0126788 A1 Jun. 7, 2007

(30) Foreign Application Priority Data

Sep. 29, 2005 (JP) ..... 2005-284905

(51) Int. Cl.
*B41J 2/145* (2006.01)
*B41J 2/15* (2006.01)

(52) U.S. Cl. ..... 347/40; 347/20

(58) Field of Classification Search ..... 347/40, 347/43, 20

See application file for complete search history.

(56) References Cited

U.S. PATENT DOCUMENTS 6,254,218 B1 * 7/2001 Suzuki et al. ..... 347/43
6,896,357 B2 * 5/2005 Murakami et al. ..... 347/43
6,926,382 B2 8/2005 Ito et al.
6,976,748 B2 * 12/2005 Yabe et al. ..... 347/43
7,014,297 B2 3/2006 Miki et al.
7,073,888 B2 * 7/2006 Katakura ..... 347/40
7,273,264 B2 * 9/2007 Nagashima ..... 347/43
7,350,902 B2 * 4/2008 Dietl et al. ..... 347/43
2002/0140774 A1 10/2002 Miki et al.

FOREIGN PATENT DOCUMENTS

JP 2000130033 A 5/2000
JP 200380700 A 3/2003
JP 2003326712 A 11/2003
JP 2004098579 A 4/2004
JP 2004114434 A 4/2004

* cited by examiner

*Primary Examiner*—Stephen D Meier
*Assistant Examiner*—Carlos A Martinez, Jr.
(74) *Attorney, Agent, or Firm*—Baker Botts L.L.P.

(57) ABSTRACT

An ink-jet head has a plurality of nozzles formed on an ink-jetting surface, a plurality of manifolds, and a plurality of individual ink channel groups each of which includes a plurality of individual ink channels communicating with nozzles and one of the manifolds. Symmetric-centers of multiple nozzles with respect to one of the individual ink-channel groups are aligned in a predetermined direction. Further, when these nozzles are shifted on the ink-jetting surface such that the symmetric-centers are coincident with one another, then central axis points of the nozzles are mutually different in location. With this, there is provided an ink-jet head which makes it possible to print an image with high image-quality at a high speed.

16 Claims, 18 Drawing Sheets

INKJET HEAD, INKJET RECORDING APPARATUS AND METHOD OF FORMING DOT PATTERN

CROSS REFERENCE TO RELATED APPLICATION

The present application claims priority from Japanese Patent Application No. 2005-284905, filed on Sep. 29, 2005, the disclosure of which is incorporated herein by reference in its entirety.

BACKGROUND OF THE INVENTION

1. Field of the Invention

The present invention relates to an inkjet head (ink-jet head) jetting an ink onto a recording medium, an inkjet recording apparatus, and a method of forming a dot pattern.

2. Description of the Related Art

As a recording head which performs printing onto a recording medium such as a paper, there is an ink-jet recording apparatus having an ink-jet head which jets ink droplets onto the paper or the like. Various types of ink-jet heads are available as such an ink-jet head. For example, a widely-known serial-type ink-jet head (for example, see FIG. 1 of U.S. Pat. No. 6,926,382) includes a channel unit in which a plurality of individual ink channels extending from a common ink chamber to nozzles respectively are formed, and the serial-type ink-jet head forms a desired color image onto the paper by jetting ink droplets of a plurality of color inks (for example, black, cyan, yellow and magenta inks) onto the paper, while reciprocating in a direction (CR direction) perpendicular to a paper feeding direction (LF direction). In such a serial-type ink-jet head as described above, a plurality of nozzles, jetting ink droplets of different color inks respectively are arranged in rows in the CR direction, and a plurality of nozzles such that nozzles, among the nozzles, jetting a color ink, among the color inks, are aligned in the LF direction. The ink-jet head jets the ink droplets from the nozzles while moving in the CR direction. The ink droplets of the different color inks jetted from the nozzles are landed at a same position on the paper to form a plurality of small dots, and these small dots overlap with one another to form a dot.

SUMMARY OF THE INVENTION

At this time, an order in which ink droplets of the color inks land (landing order), i.e. an order in which small dots are formed, are different during an outgoing movement of the ink-jet head and during a returning movement of the ink-jet head. Here, the term "outgoing movement" means a movement directed away from a standby position of the ink-jet head (first movement), and the term "returning movement" means a movement directed toward the standby position of the ink-jet head (second movement). For example, when ink droplets are jetted in an order of magenta and cyan during the first movement of the ink-jet head, then during the second movement of the ink-jet head ink droplets are jetted in an order reverse from that in the first order namely in order of cyan and magenta. At this time, as shown in FIG. 18, a small dot 91 in magenta and a small dot 92 in cyan are formed successively during the first movement. On the other hand, a small dot 92 in cyan and a small dot 91 in magenta are formed in this order during the second movement. Note that in FIG. 18, positions of the small dots 91, 92 are slightly different from each other for convenience of explanation, but the positions of the dots 91, 92 are in fact the same. Therefore, even in the cases in each of which same-colored dots are formed, a difference occurs in some cases in color tint (color shade) of the dots between the color tint of the dots formed during the first movement of the ink-jet head and the color tint of the dots formed during the second movement of the ink-jet head. For the purpose of avoiding this difference in color tint to realize image printing with high image-quality, the printing is performed in some cases only during the first movement or during the second movement. In this case, however, the printing speed significantly decreases than a printing speed at which printing is performed both during the first movement and during the second movement.

An object of the present invention is to provide an ink-jet head and an ink-jet recording apparatus which make it possible to perform the image printing with high image-quality at a high speed, and to provide a method of forming a dot pattern suitable for performing the image printing with high image-quality at a high speed.

According to a first aspect of the present invention, there is provided an ink-jet head which jets a plurality of different color inks, the ink-jet head including: a plurality of pressure chambers aligned in a first direction; a plurality of ink chambers which communicate with the pressure chambers, respectively and each of which stores one of the inks; an ink-jetting surface on which a plurality of nozzle holes of nozzles are formed, the nozzles communicating with the pressure chambers respectively and including a plurality of multi-nozzles each of which has a plurality of nozzle holes; and a plurality of individual ink channels each of which communicates with one of the ink chambers, one of the pressure chambers, and one of the nozzles, wherein: the nozzle holes of each of the multi-nozzles communicate with one of the individual ink channels; symmetric-centers of the plurality of nozzles are arranged on the ink-jetting surface in a line extending in the first direction; and when one nozzle, among the plurality of nozzles, is shifted in the first direction such that a symmetric-center of the one nozzle overlaps with a symmetric-center of another nozzle, a center of a nozzle hole of the one nozzle is located at a position different from a center of a nozzle hole of the another nozzle.

According to the first aspect of the present invention, for example, when a dot pattern is to be formed on a recording medium with ink droplets jetted from nozzles each formed in one of the individual ink channels each of which communicates with one of the pressure chambers aligned in a predetermined direction, then the ink droplets jetted from the nozzles form a plurality of small dots of which centers are at positions mutually different and adjacent on the recording medium, and the small dots partially overlap with each other to construct or form a dot pattern. Therefore, a proportion of an area in which the small dots mutually overlap becomes small, than in a case in which centers of all of the small dots are formed at the same position on the recording medium. Accordingly, when each of the different color inks is stored in one of the ink chambers and the printing is performed while the ink-jet head reciprocating in the one direction (reciprocating direction), difference in color tint of the dots becomes small between the color tint of the dots formed during the outgoing movement and the color tint of the dots formed during the returning movement, than in a case in which the centers of the small dots are formed at the same position on the recording medium. In addition, the multi-nozzles each having a plurality of jetting ports (nozzle holes) are communicated with the pressure chambers, and at least two multi-nozzles, among the multi-nozzles, have the centers of the nozzle holes located at mutually different positions. Consequently, the proportion of the area in which the small dots mutually overlap becomes small, than in a case in which the number of multi-nozzles having the centers of the nozzle holes located at mutually different positions is less than two. As a result, the difference in color tint of the dots becomes significantly small between the color tint of the dots formed during the first movement and the color tint of the dots formed during the second movement. Accordingly, the image printing can be performed with high image-quality even when ink-jetting is carried out both during the first movement and during the second movement.

In the ink-jet head of the present invention, the inks may be inks other than a black ink; and a number of the ink chambers may be at least three. Further, in this case, the ink-jet head of the present invention is applicable also to color inks including the three primary colors of cyan, magenta and yellow, and full-color printing can be performed with high image-quality by using the ink-jet head of the present invention.

In the ink-jet head of the present invention, a plurality of pressure chamber-rows may be formed by forming a plurality of pressure chamber-columns aligned in a second direction different from the first direction, each of the pressure chamber-columns including pressure chambers, among the pressure chambers, aligned in the first direction and each of the pressure chamber-rows including pressure chambers, among the pressure chambers, aligned in the second direction; each of the ink chambers may communicate with all pressure chambers included in one of the pressure chamber-columns; and pressure chambers, among the plurality of pressure chambers, communicating with one of the ink chambers may be communicated with nozzles, among the plurality of nozzles, which are provided in a number same as that of the pressure chambers. In this case, a dot pattern is formed for each of the pressure chamber-columns, thereby making it possible to form a plurality of dot patterns simultaneously.

In the ink-jet head of the present invention, the plurality of nozzles may include a single nozzle formed with one nozzle hole, and a center of the single nozzle and symmetric-centers of the multi-nozzles may be positioned on the line extending in the predetermined direction. This improves an axisymmetrical property with respect to the shape of the dots constructed of small dots, thereby improving the printing image-quality.

In the ink-jet head of the present invention, in each of the pressure chamber-columns, a maximum distance, between centers of the nozzle holes of each of the multi-nozzles, in a direction perpendicular to the predetermined direction, may be mutually equal among the multi-nozzles. This makes a width of the dots in the scanning direction equal among the dots, thereby improving the printing image-quality.

In the ink-jet head of the present invention, when in each of the pressure chamber-columns, the multi-nozzles are shifted on the ink-jetting surface in the predetermined direction to make symmetric-centers of the multi-nozzles mutually coincident, the multi-nozzles in each of the pressure chamber-columns may include at least two multi-nozzles which do not mutually overlap, and each of which may be formed with nozzle holes in a mutually same number. In this case, the proportion of the area becomes small in which the small dots, formed of ink droplets jetted from the multi-nozzles which belong to a same pressure chamber-columns, among the pressure chamber-columns, are overlapped.

In the ink-jet head of the present invention, when the multi-nozzles in each of the pressure chamber-columns are shifted on the ink-jetting surface in the predetermined direction to make symmetric-centers of the multi-nozzles to be mutually coincident, none of the multi-nozzles may mutually overlap, and each of the multi-nozzles may be formed with the nozzle holes in a number same among the multi-nozzles. Accordingly, the proportion of the area in which the small dots overlap becomes small, the small dots being formed of ink droplets jetted from the multi-nozzles which belong to one of the pressure chamber-columns. Further, the shape of the small dots becomes uniform, thereby improving the printing image-quality.

In the ink-jet head of the present invention, when in each of the pressure chamber-columns, the multi-nozzles are shifted on the ink-jetting surface in the predetermined direction to make the symmetric-centers of the multi-nozzles to mutually coincide, nozzle holes of a multi-nozzle, among the multi-nozzles, may be mutually separated from nozzle holes of another multi-nozzle without overlapping. This assuredly reduces the proportion of the area in which the small dots overlap, the small dots being formed of ink droplets jetted from the multi-nozzles communicating with pressure chambers which belong to a same pressure chamber-column among the pressure chamber-columns.

In the ink-jet head of the present invention, two pieces of multi-nozzles may be provided in each of the pressure chamber-columns; each of the two multi-nozzles may be formed with two nozzle holes; and two lines, each connecting centers of two nozzle holes of each of the two multi-nozzles may be extending in mutually orthogonal directions. This reduces the proportion of the area in which the small dots overlap, the small dots being formed of ink droplets jetted from the multi-nozzles which belong to a same pressure chamber-column among the pressure chamber-columns.

In the ink-jet head of the present invention, two pieces of the multi-nozzles are provided in each of the pressure chamber-columns; each of the two multi-nozzles may be formed with three nozzle holes; and centers of the three nozzle holes of one of the two multi-nozzles and centers of the three nozzle holes of the other of the two multi-nozzles may be located at positions corresponding to apexes of two equilateral triangles respectively, which are rotated by 180 degrees from each other. This reduces the proportion of the area in which the small dots overlap, the small dots being formed of ink droplets jetted from the multi-nozzles which belong to a same pressure chamber-column among the pressure chamber-columns. Further, the shape of the small dots becomes close to a circle, thereby improving the printing image-quality.

In the ink-jet head of the present invention, when nozzles, among the nozzles, communicating with individual ink channels, among the plurality of individual ink channels, which communicate with one of the ink chambers are shifted on the ink-jetting surface to make symmetric-centers of the nozzles to be mutually coincident, centers of nozzle holes of the nozzles may be mutually coincident. This prevents the shape of the small dots from being greatly different among the small dots of ink droplets jetted from the nozzles communicating with the individual ink channels which communicate with one of the ink chambers. Therefore, the printing image-quality is improved.

In the ink-jet head of the present invention, a total area dimension, of nozzle holes of nozzles, among the plurality of nozzles, communicating with pressure chambers included in each of the pressure chamber-columns, may be mutually same among the nozzles. This makes a volume, of ink droplet or droplets jetted from a nozzle or nozzles formed in each of the individual ink channels, to be uniform. This makes the area dimension of the small dots to be substantially same, thereby improving the printing image-quality.

In the ink-jet head of the present invention, ink-jetting speeds, at each of which each of the inks is jetted from nozzles, among the nozzles, communicating with the pressure chambers included in one of the pressure chamber-columns, may be mutually same. This uniformizes the jetting speeds at each of which ink droplets are jetted from a nozzle or a multiple nozzle formed in one of the individual ink channels. Accordingly, the landing accuracy of the small dots becomes satisfactory, thereby improving the printing image-quality.

According to a second aspect of the present invention, there is provided an ink-jet recording apparatus which performs recording by jetting a plurality of different color inks onto a recording medium, the apparatus including: a transport unit which transports the recording medium in a predetermined transporting direction; an ink-jet head, which jets the inks onto the recording medium while reciprocating in a direction perpendicular to the transporting direction, and which includes a plurality of pressure chambers aligned in a first direction, a plurality of ink chambers which communicate with the pressure chambers respectively and each of which stores one of the inks, and an ink-jetting surface on which a plurality of nozzle holes of nozzles are formed, the nozzles communicating with the pressure chambers respectively and including a plurality of multi-nozzles each of which has a plurality of nozzle holes; and a plurality of individual ink channels each of which communicates with one of the ink chambers, one of the pressure chambers, and one of the nozzles; wherein the nozzle holes of each of the multi-nozzles communicate with one of the individual ink channels; symmetric-centers of the nozzles are arranged on the ink-jetting surface in a line extending in the first direction; and when one nozzle, among the plurality of nozzles, is shifted in the first direction such that a symmetric-center of the one nozzle overlaps with a symmetric-center of another nozzle, a center of a nozzle hole of the one nozzle is located at a position different from a center of a nozzle hole of the another nozzle.

According to the second aspect of the present invention, even in a case in which an image or the like is printed on the recording medium while reciprocating the ink-jet head in a direction perpendicular to a direction in which the recording medium is transported or fed, it is possible to make a difference in color tint greatly small between the color tint of the dots formed during the outgoing movement and the color tint of the dots formed during the returning movement, thereby realizing the high-speed and high-image-quality printing.

According to a third aspect of the present invention, there is provided a method of forming a dot pattern by landing a plurality of liquid droplets of inks on a recording medium to form the dot pattern with dots corresponding to the liquid droplets of the inks, the method including: forming a first dot corresponding to a liquid droplet of a first ink having a first color; and forming a second dot corresponding to a liquid droplet of a second ink having a second color such that a centroid (center of gravity) of the first dot and a centroid of the second dot coincide with each other and that an area of the first color and an area of the second color are respectively formed.

According to the third aspect of the present invention, when a dot pattern is formed by overlapping a plurality of colors, the dot pattern can be formed to have nearly q same color tint regardless of the order in which the colors are overlapped.

According to the method of forming the dot pattern of the present invention, the liquid droplet of the second ink may include a plurality of small liquid droplets, of the second ink, which are jetted concurrently; and the second liquid droplet of the second ink may be jetted from a multi-nozzle. In these cases, a dot pattern can be formed easily by using an ink-jet head, such as an ink-jet head having a multi-nozzle which makes it possible to concurrently jet small liquid droplets of inks.

In the present application, the term "symmetric-center (symmetric center point)" means a center of a nozzle in the case of a single nozzle having one nozzle hole; and in the case of a multi-nozzle having multiple nozzle holes, the term "symmetric-center" means a point which is located by an identical distance from centers (central axis points) of the multiple nozzle holes.

PREFERRED MODE FOR CARRYING OUT THE INVENTION

First Embodiment

Figure 1:
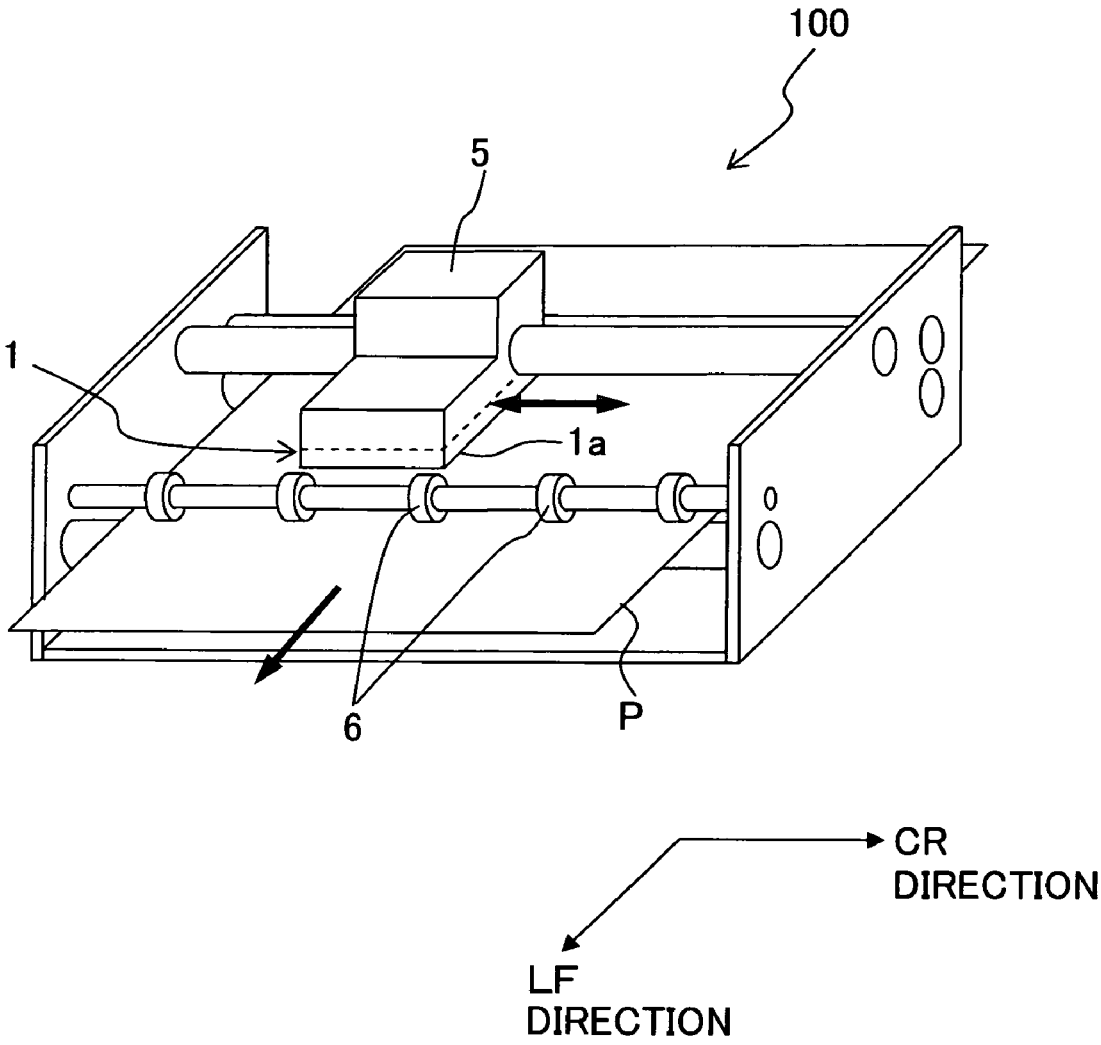
FIG. 1 is a schematic arrangement illustrating an ink-jet printer according to a first embodiment of the present invention.

A first embodiment of the present invention will be explained. First, with reference to FIG. 1, an explanation will be given briefly as to an ink-jet printer (ink-jet recording apparatus) provided with an ink-jet head 1 of the first embodiment of the present invention. As shown in FIG. 1, an ink-jet printer 100 includes a carriage 5 which is movable to a left and right direction (predetermined direction: CR direction) in FIG. 1; a serial-type ink-jet head 1 which is provided on the carriage 5 to jet droplets of four color inks (black, yellow, cyan, and magenta inks) onto a recording paper P; and feed rollers 6 which feed or transport the recording paper P forward in FIG. 1. The ink-jet head 1 moves in the CR direction integrally with the carriage 5 and jets droplets of the inks (ink droplets) onto the recording paper P from jetting ports formed on a lower surface of an ink-jetting surface la. The recording paper P, onto which ink droplets have been jetted from the ink-jet head 1, is discharged in a forward direction (a paper feeding direction: LF direction) by the feed rollers 6.

Figure 2:
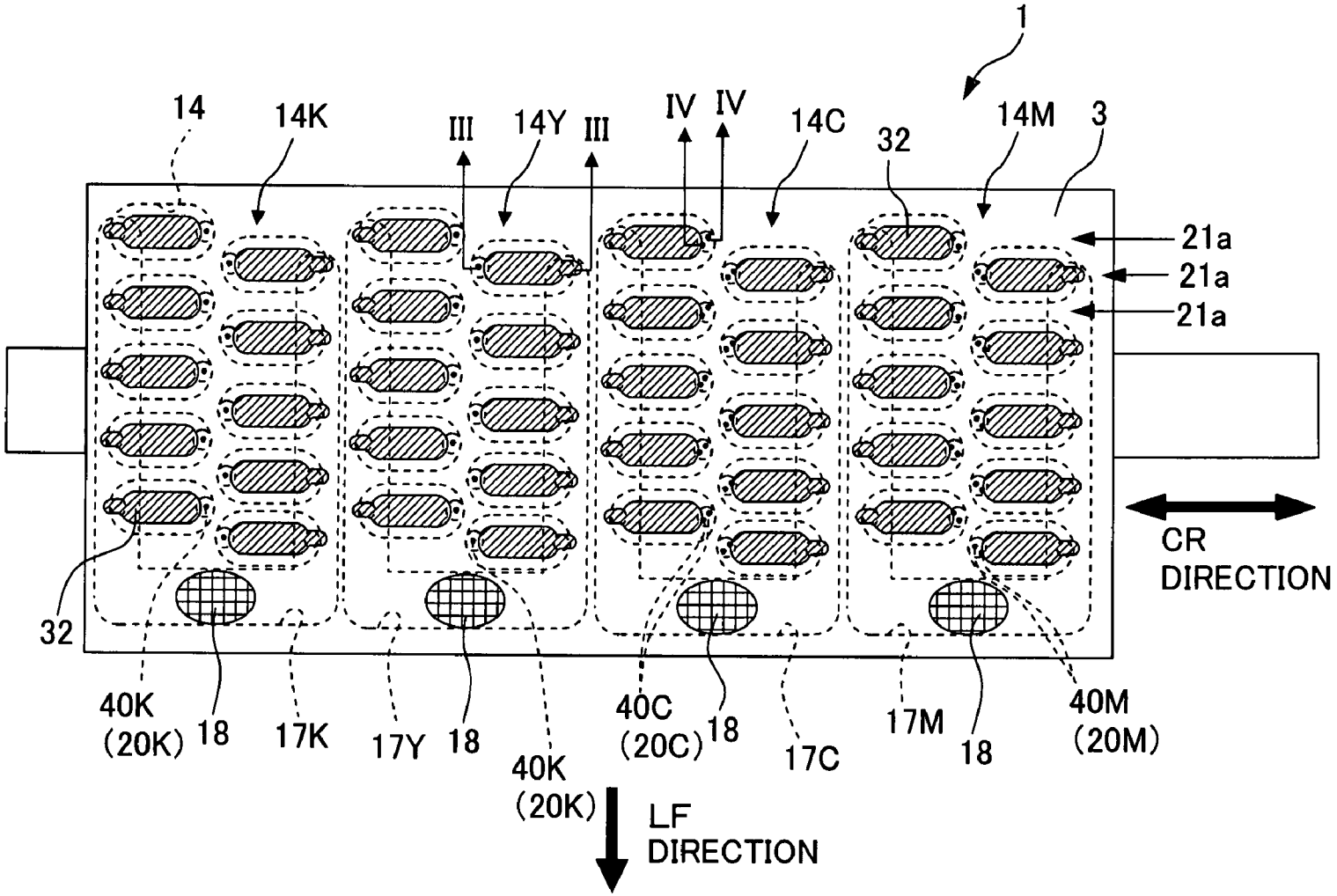
FIG. 2 is a plan view of an ink-jet head shown in FIG. 1.
Figure 3:
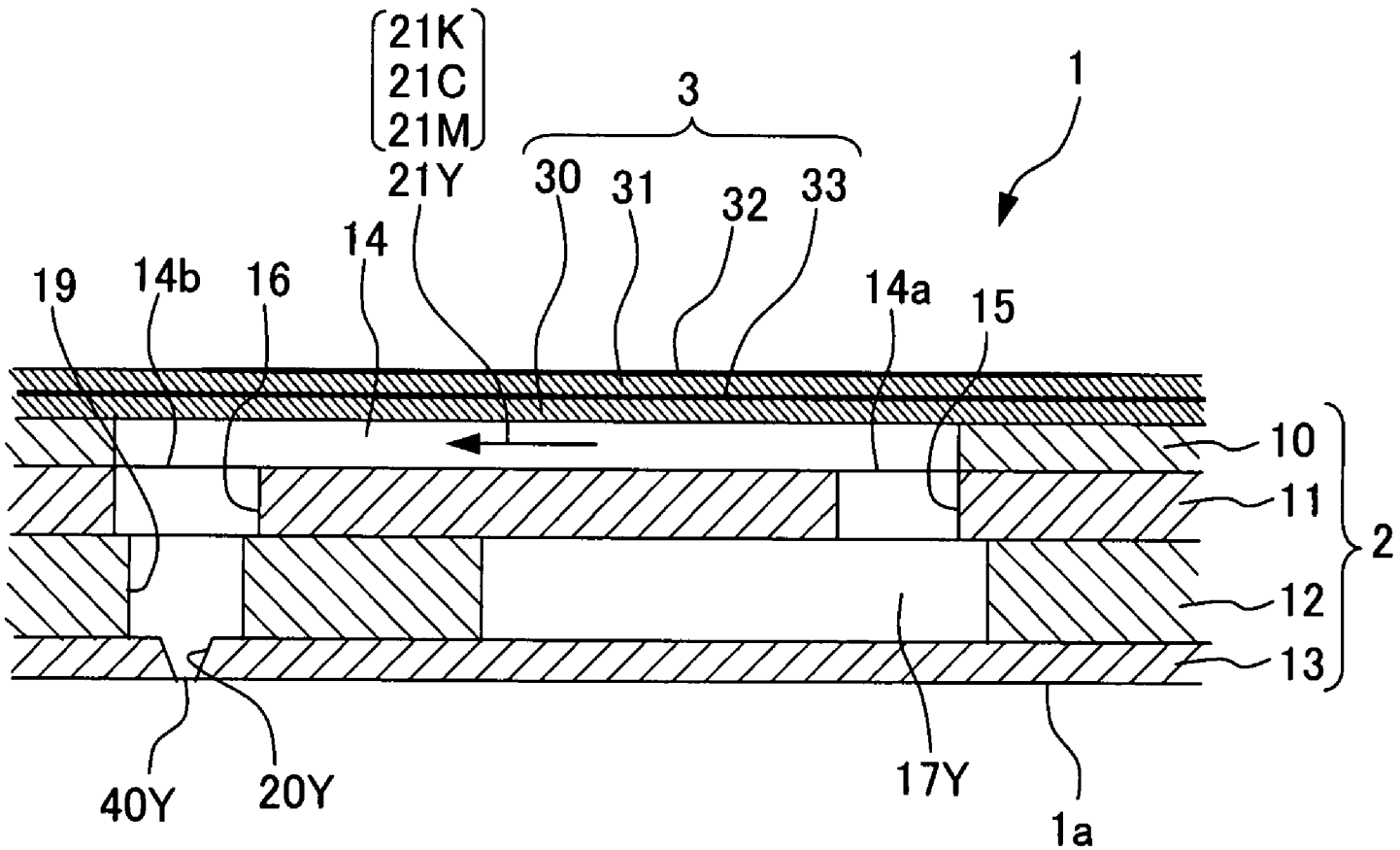
FIG. 3 is a cross-sectional view taken along a line III-III shown in FIG. 2.
Figure 4:
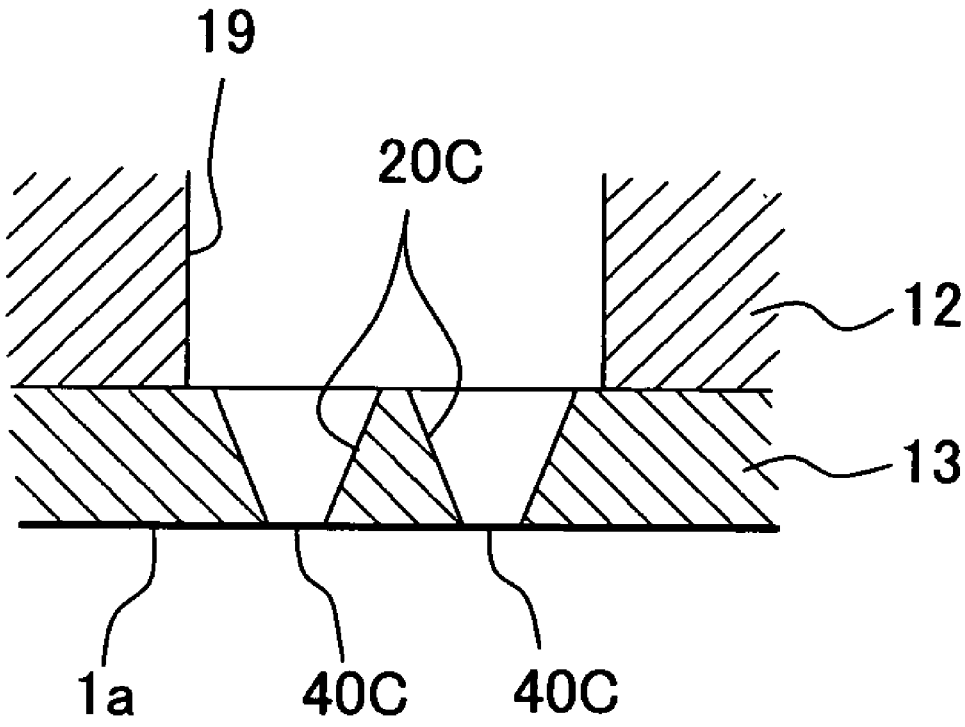
FIG. 4 is a cross-sectional view taken along a line IV-IV line shown in FIG. 2.

Next, the ink-jet head 1 will be explained with reference to FIGS. 2, 3, and 4. As shown in FIGS. 2 and 3, the ink-jet head 1 has a shape of rectangle extending in the CR direction in a plan view, and the ink-jet head 1 includes a channel unit 2 in which an ink channel is formed, and a piezoelectric actuator unit 3 arranged on an upper surface of the channel unit 2.

First, the channel unit 2 will be explained. The channel unit 2 includes a cavity plate 10, a base plate 11, a manifold plate 12, and a nozzle plate 13, and the plates 10 to 13 are joined together in laminated layers. The cavity plate 10, the base plate 11, and the manifold plate 12 are stainless steel plates each having a substantially rectangular shape. The nozzle plate 13 is formed, for example, of a synthetic high-molecular resin material such as polyimide, and the nozzle plate 13 is adhered to a lower surface of the manifold plate 12. Alternatively, similarly to the three plates 10 to 12, the nozzle plate 13 may also be formed of a metal material such as stainless steel.

Forty pieces of pressure chambers 14 aligned in rows along a plane are formed in the cavity plate 10. Each of the pressure chambers 14 is open, toward the piezoelectric actuator unit 3 (upward in FIG. 3), on an upper surface of the cavity plate 10, and each of the pressure chambers 14 has a substantially elliptic shape extending in the CR direction. Further, an ink inflow port 14*a* and an ink outflow port 14*b* are arranged at both end portions, of each of the pressure chambers 14, in the longitudinal direction. Pressure chamber groups 14K, 14Y, 14C, and 14M are formed each with ten pieces of the pressure chambers 14 arranged in a zigzag or staggered pattern in the LF direction. The pressure chamber groups 14K, 14Y, 14C, and 14M are aligned in this order in the CR direction. Forty pieces of the pressure chambers 14 in total are aligned in a matrix form in the LF direction (up and down direction in FIG. 2) and in the CR direction (left and right direction in FIG. 2). With this arrangement, there are formed ten pressure chamber-columns aligned in the CR direction and two pressure chamber-rows, per each of the colors, arranged in the LF direction.

Communicating holes 15 are formed in the base plate 11 at positions each overlapping in a plan view with an ink inflow port 14*a* of one of the pressure chambers 14, and communicating holes 16 are formed in the base plate 11 at positions each overlapping with an ink outflow port 14*b* of one of the pressure chambers 14. Four manifolds (common ink chambers) 17K, 17Y, 17C, and 17M, which accommodate different color inks respectively are formed in the manifold plate 12 at positions overlapping in a plan view with the communicating holes 15 which communicate with the pressure chambers 14 belonging to one of the pressure chamber groups 14K, 14Y, 14C, and 14M. These four manifolds 17K, 17Y, 17C, and 17M are aligned in this order in the CR direction, corresponding to the pressure chamber groups 14K, 14Y, 14C, and 14M, respectively. Moreover, each of the manifolds 17K, 17Y, 17C, and 17M communicates with one of the ink supply ports 18 formed in the ink-jet head 1 at the vicinity of one end there (downward end in FIG. 2). Further, each of the black ink, yellow ink, cyan ink, and magenta ink is supplied from one of the unillustrated ink tanks, each accommodating one of the color inks to the manifolds 17K, 17Y, 17C, and 17M respectively, via one of the ink supply ports 18. Furthermore, communicating holes 19 are formed in the manifold plate 12 at positions each overlapping in a plan view with one of the communicating holes 16.

Nozzles 20K are formed in the nozzle plate 13 at positions each overlapping in a plan view with one of the communicating holes 19 which corresponds to one of the pressure chambers 14 belonging to the pressure chamber group 14K, and nozzles 20Y are formed in the nozzle plate 13 at positions each overlapping with one of the communicating holes 19 which corresponds to one of the pressure chambers 14 belonging to the pressure chamber group 14Y. Also, two nozzles 20C are formed in the nozzle plate 13 at positions each overlapping with one of the communicating holes 19 which corresponds to one of the pressure chambers 14 belonging to the pressure chamber group 14C, as shown in FIG. 4, and two nozzles 20M are formed in the nozzle plate 13 at positions each overlapping with one of the communicating holes 19 which corresponds to one of the pressure chambers 14 belonging to the pressure chamber group 14M. Note that in FIG. 3, a cross-section of one of the pressure chambers 14 belonging to the pressure chamber group 14Y is shown, but a cross-section of one of the pressure chambers 14 belonging to the pressure chamber group 14K is substantially same as the cross-section of one of the pressure chambers 14 in the pressure chamber group 14Y. Also, note that in FIG. 4, a cross-section of a nozzle 20C is shown, but a cross-section of a nozzle 20M is substantially same as the cross-section of the nozzle 20C. These nozzles 20K, 20Y, 20C, and 20M are formed, for example, by performing an excimer laser processing on a substrate of a synthetic high-molecular resin material such as polyimide. Jetting ports 40K, 40Y, 40C, and 40M are openings of the nozzles 20K, 20Y, 20C, and 20M respectively, on the ink-jetting surface 1*a* which is the lower surface of the nozzle plate 13 (see FIG. 5). Note that each of the nozzles 20C and 20M having multiple jetting ports (nozzle holes) 40C and 40M respectively, corresponds to a multi-nozzle, and that the nozzle 20Y having a single jetting port (nozzle hole) corresponds to a single nozzle.

In this way, the manifolds 17K, 17Y, 17C, and 17M communicate with the ink inflow ports 14*a* of the pressure chambers 14 via the communicating holes 15. Further, the ink outflow port 14*b* of each of the pressure chambers 14 communicates with one of the nozzles 20K, 20Y, 20C, and 20M via the communicating holes 16 and 19. In other words, there are formed, in the channel unit 2, ten individual ink channels 21K each of which reaches the jetting port 40K of the pressure chamber from the manifold 17K via one of the pressure chambers 14, ten individual ink channels 21Y each of which reaches the jetting port 40Y of the pressure chamber from the manifold 17Y via one of the pressure chambers 14, ten individual ink channels 21C each of which reaches the jetting ports 40C of the pressure chamber from the manifold 17C via one of the pressure chambers 14, and ten individual ink channels 21M each of which reaches the jetting ports 40M of the pressure chamber from the manifold 17M via one of the pressure chambers 14.

In addition, there are formed, in the channel unit 2, ten pieces of individual ink channel group 21*a* each of which is formed of four individual ink channels 21K, 21Y, 21C, and 21M which are aligned in the CR direction. Here, each of the individual ink channels 21K, 21Y, 21C, and 21M communicates with one of the different manifolds 17K, 17Y, 17C, and 17M. In other words, each of the individual ink channel groups 21*a* includes an individual ink channel 21K having a jetting port 40K, an individual ink channel 21Y having a jetting port 40Y, an individual ink channel 21C having two jetting ports 40C, and an individual ink channel 21M having two jetting ports 40M.

Figure 5:
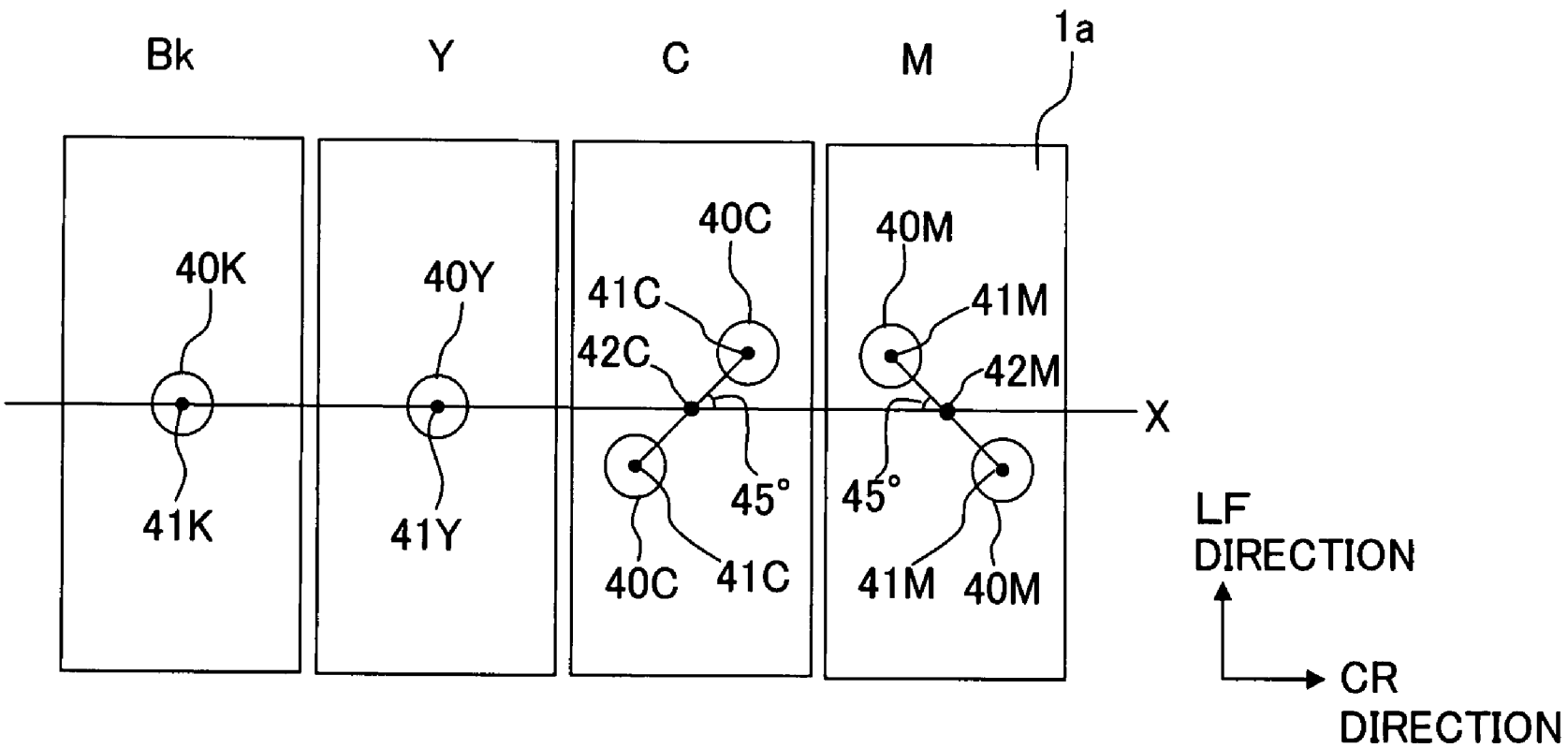
FIG. 5 is a diagram showing a positional relationship, among jetting ports in an individual ink-channel group, on an ink-jetting surface of FIG. 1.
Figure 6:
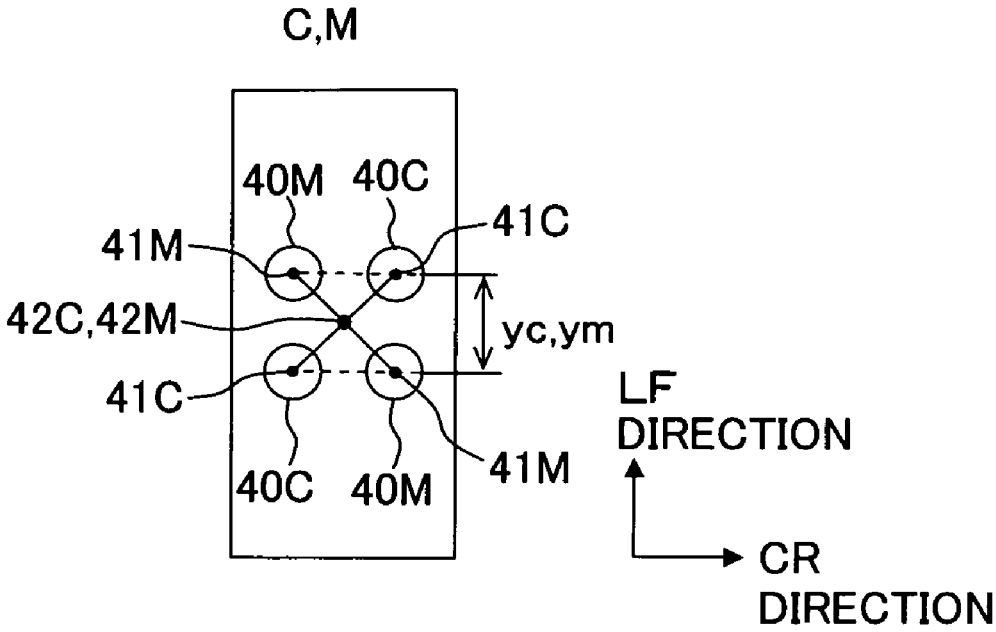
FIG. 6 is a diagram showing a state when the jetting ports shown in FIG. 5 are shifted on the ink-jetting surface in the CR direction to make symmetric-centers of the jetting ports coincide with one another.

Here, with reference to FIGS. 5 and 6, an explanation will be given about a positional relationship among the jetting ports 40K, 40Y, 40C, and 40M associated with one of the individual ink-channel groups 21*a*. FIG. 5 is a diagram showing a positional relationship, on the ink-jetting surface 1*a*, among the jetting ports 40K, 40Y, 40C, and 40M associated with one of the individual ink-channel groups 21*a*. Note that in FIG. 5, rectangular areas, which are on the ink-jetting surface 1*a* and at each of which one of the jetting ports 40K, 40Y, 40C, and 40M is formed, are shown in a state viewed from a position above the rectangular areas (upward in FIG. 3) and in a state in which the jetting ports 40K, 40Y, 40C, and 40M are shifted in the CR direction such that the jetting ports are mutually adjacent. FIG. 6 is a diagram showing a state in which the jetting ports 40C and 40M are shifted such that a symmetric-center 42C of the jetting ports 40C and a symmetric-center 42M of the jetting ports 40M coincide with each other.

The term "symmetric-center," which will be explained in the embodiment, means a point, among a plurality of points at each of which linear distances each between one of the points and a central axis point of one of the two jetting ports are equal, at which distances each between the point and the central axis point of one of the two jetting ports becomes minimum. In other words, the term "symmetric-center" means a midpoint of a line connecting the central points of the two jetting ports.

As shown in FIG. 5, central axis points 41K and 41Y of the jetting ports 40K and 40Y respectively and symmetric-centers 42C and 42M of the jetting ports 40C and 40M respectively are located on a straight line X extending in the CR direction. Moreover, the central axis points 41C of the two jetting ports 40C are located, at positions equal in distance from the symmetric-center 42C, on a line inclined by 45 degrees counterclockwise with respect to the line X. Also, the central axis points 41M of the two jetting ports 40M are located, at positions equal in distance from the symmetric-center 42M, on a line inclined by 45 degrees clockwise with respect to the line X. As shown in FIG. 6, when the jetting ports 40C and 40M are shifted in the CR direction such that the symmetric-centers 42C and 42M coincide with each other, a line connecting the central axis points 41C of the two jetting ports 40C and a line connecting the central axis points 41M of the two jetting ports 40M are orthogonal to each other. Further, the central axis points 41Y, 41C, and 41M of the jetting ports 40Y, 40C, and 40M respectively are mutually different in location. In other words, any ones of the jetting ports 40Y, 40C, 40M do not share a same central axis point. Also, the jetting ports 40C and 40M do not overlap with each other and are isolated and away from each other.

Further, a distance yc between the two central axis points 41C in the LF direction and a distance ym between the two central axis points 41M in the LF direction are equal to each other. In addition, opening areas (opening-area dimension) of the jetting ports 40K, 40Y, 40C, and 40M are determined such that the inks are jetted from the jetting ports 40K, 40Y, 40C, and 40M respectively, at an ink-jetting speed which is same among the jetting ports. The opening areas of the jetting ports 40K, 40Y, 40C, and 40M are thus approximately same in size among the jetting ports. Furthermore, when the jetting ports 40C and 40M, which communicate with the manifolds 17C and 17M respectively, in the individual ink channels 21C and 21M, are moved in parallel on the ink-jetting surface la such that the symmetric-centers 42C and 42M overlap each other, then the central axis points 41C and 41M of the jetting ports 40C and 40M coincide with each other.

Next, back to FIG. 3, the piezoelectric actuator unit 3 will be explained. The piezoelectric actuator 3 applies a jetting pressure to the ink in each of the pressure chambers 14, and the piezoelectric actuator unit 3 is formed on an entire surface of the channel unit 2 to cover the pressure chambers 14.

The piezoelectric actuator unit 3 is provided with a vibration plate 30 arranged on an upper surface of the channel unit 2; a piezoelectric layer 31 stacked over the vibration plate 30; a plurality of individual electrodes 32 formed on an upper surface of the piezoelectric layer 31, corresponding to the pressure chambers 14 respectively; a common electrode 33 arranged between the vibration plate 30 and the piezoelectric layer 31 and sandwiching the piezoelectric layer 31 with the individual electrodes 32 therebetween. The vibration plate 30 and the piezoelectric layer 31 are formed as a continuously flat plate layer which covers all the pressure chambers 14.

The vibration plate 30 is a plate having a substantially rectangular shape, and composed of a lead zirconate titanate (PZT) which is a solid solution of lead zirconate and lead titanate and is ferroelectric, and the vibration plate 30 is joined to the cavity plate 10 so as to cover all the pressure chambers 14. The piezoelectric layer 31 is also a plate having a substantially rectangular shape and composed of PZT, similarly to the vibration plate 30, and the piezoelectric layer 31 entirely covers all the pressure chambers 14 on an upper surface of the vibration plate 30.

Each of the individual electrodes 32 faces, on the upper surface of the piezoelectric layer 31, a central portion of one of the pressure chambers 14, and each of the individual electrodes 32 is a membrane electrode or thin-film electrode of an elliptic shape extending in the scanning direction. The individual electrodes 32 are formed of an electrically conductive material (for example, gold, copper, silver, palladium, platinum, titanium, or the like). The common electrode 33 is arranged between the vibration plate 30 and the piezoelectric layer 31, and the common electrode 33 is a membrane electrode of a substantially rectangular shape extending so as to face the individual electrodes 32. The piezoelectric layer 31 is sandwiched between the common electrode 33 and the individual electrodes 32. In addition, the common electrode 33 is formed of an electrically conductive material, similarly to the individual electrodes 32, and the common electrode 33 is always maintained at ground electric potential.

Next, operations of the piezoelectric actuator unit 3 upon jetting ink will be explained. When a drive potential is selectively applied from an unillustrated driver IC to the individual electrodes 32, a predetermined drive voltage is generated between the common electrode 33 and an individual electrode 32, among the individual electrodes 32, to which the drive potential is applied. With this, an electric field in a direction of thickness of the piezoelectric layer 31 (thickness direction) is generated in the piezoelectric layer 31 at an area thereof sandwiched between the individual electrode 32 and the common electrode 33, the area facing the central portion of one of the pressure chambers 14, and corresponding to the individual electrode 32. At this time, the area, in the piezoelectric layer 31, facing the central portion of the pressure chamber 14, becomes an active zone (an active area) which deforms by itself. This active zone is elongated or expanded in the thickness direction in which the piezoelectric layer 31 is polarized, and the active zone is contracted in a direction which is parallel to a plane of the piezoelectric layer 31 and is perpendicular to the direction in which the piezoelectric layer 31 is polarized. On the other hand, the vibration plate 30 becomes an inactive zone at a portion thereof corresponding to the individual electrode 32, since no electric field is generated in the vibration plate.

Consequently, a difference in deformation in the direction perpendicular to the direction in which the piezoelectric layer 31 is polarized is generated in each of the piezoelectric layer 31 and the vibration plate 30, at the area thereof facing the central portion of the pressure chamber 14. Accordingly, the vibration plate 30 is deformed at this area facing the pressure chamber 14 to project toward the pressure chamber 14 with the center of the area as an apex (unimorph deformation). Accompanying with the deformation of the vibration plate 30, a volume in the pressure chamber 14 is decreased and a positive pressure wave is generated in the pressure chamber 14. The positive pressure wave generated in the pressure chamber 14 is propagated to one of the individual ink channels 21K, 21Y, 21C, and 21M toward one of the nozzles 20K, 20Y, 20C, and 20M, thereby jetting ink droplets from one of the jetting ports 40K, 40Y, 40C, and 40M.

As described above, the ink-jet head 1 forms a desired dot pattern onto the recording paper P by jetting ink droplets from the jetting ports 40K, 40Y, 40C, and 40M which belong to a same individual ink channel group 21*a* among the individual ink channel groups 21*a*, while moving in the CR direction with respect to the recording paper P. Moreover, when the ink-jet head 1 forms a dot having a desired color tint other than black on the recording paper P, the ink-jet head 1 jets droplets of the yellow, cyan and magenta inks selectively from the jetting ports 40Y, 40C, and 40M belonging to the same individual ink channel group. Consequently, the ink droplets are landed on the recording paper P to form a dot having a desired color tint or hue.

Figure 7:
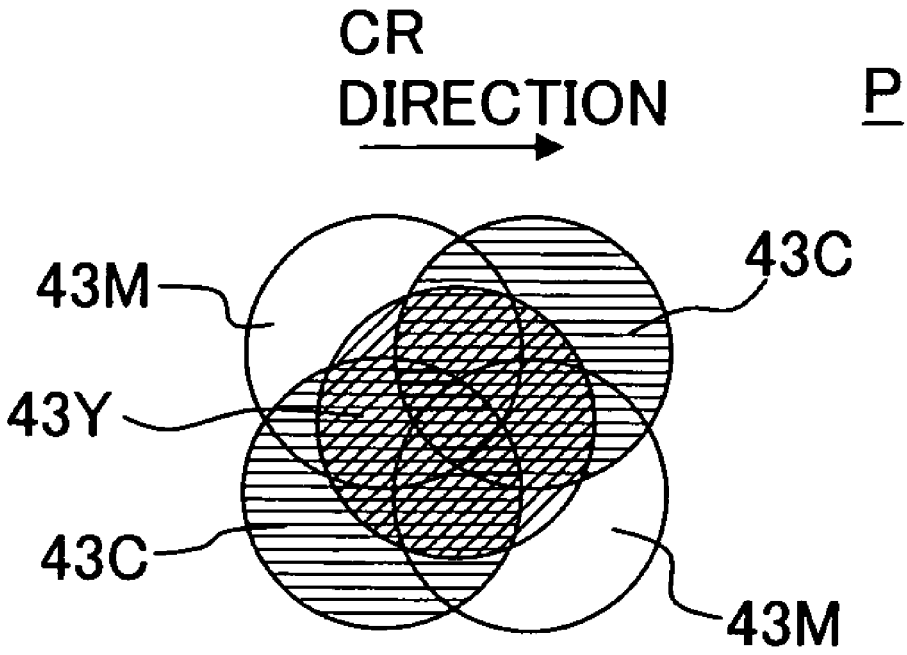
FIG. 7 is a diagram showing a state in which dots are formed on a recording paper when droplets of inks (ink droplets) are jetted from the jetting ports in an individual ink-channel group shown in FIG. 2.

FIG. 7 is a diagram showing a state of dots formed on the recording paper P when ink droplets are jetted from the jetting ports 40Y, 40C, and 40M of one of the individual ink channel groups 21*a*. When the droplets of the yellow, cyan, and magenta inks are jetted from the jetting ports 40Y, 40C, and 40M respectively, the ink droplets are jetted in an order of yellow, cyan, and magenta during the first movement (movement in the rightward direction in FIG. 5). Therefore, small dots are formed in the following order: a small dot 43Y formed of an ink droplet jetted from a jetting port 40Y, two small dots 43C formed of ink droplets jetted from two jetting ports 40C, and two small dots 43M formed of ink droplets jetted from two jetting ports 40M. On the other hand, during the second movement of the ink-jet head 1, the ink droplets are jetted in an order of magenta, cyan, and yellow. Therefore, two small dots 42M, two small dots 43C, and a small dot 43Y are formed in this order. Further, as shown in FIG. 7, the symmetric-center of the two small dots 43C coincides with the center of the small dot 43Y, and each of the centers of the small dots 43C is located on a line inclined by 45 degrees counterclockwise with respect to the CR direction. Furthermore, the symmetric-center of the two small dots 43M coincides with the center of the small dot 43Y, and each of the centers of the small dots 43M is located on a line inclined by 45 degrees clockwise with respect to the CR direction. Thus, the centers of the two small dots 43C and the centers of the two small dots 43M are away from one another at distances each from the center of the small dot 43Y and which are same among the four centers. In this manner, a dot pattern can be formed in a state that centroids (centers of gravity) of the small ink dots 43M, 43C, and 43Y of the magenta, cyan, and yellow inks respectively are mutually coincident, and that the small ink dots 43M, 43C, and 43Y do not entirely overlap with one another. In this dot pattern, a single-color area is formed for each of the inks.

According to the ink-jet head 1 described above, ink droplets jetted from the jetting ports 40Y, 40C, and 40M form the small dots 43Y, 43C, and 43M respectively, of which centers are located at positions mutually different and adjacent on the recording paper P. A dot is then constructed by partially overlapping the small dots. Therefore, a proportion of an area, in which the small dots overlap, to the total area of the dot becomes small, than in a case in which the centers of the small dots are formed at the same position on the recording paper P. Accordingly, the difference in color tint between the color tint of the dots formed during the first movement of the ink-jet head 1 and the color tint of the dots formed during the second movement of the ink-jet head 1 becomes small, than in the case in which the centers of the small dots are formed at the same position on the recording paper P. In addition, two jetting ports 40C and two jetting ports 40M are formed in the individual ink channels 21C and 21M respectively, in each of the individual ink channel groups 21*a*, and the central axis points 41C and 41M of the jetting ports 40C and 40M are located at mutually different positions. Consequently, the proportion of the area in which the small dots 43Y, 43C, and 43M overlap becomes small, than in a case in which the number of individual ink channels having multiple jetting ports is less than two. As a result, the difference in color tint between the color tint of the dots formed during the first movement of the ink-jet head 1 and the color tint of the dots formed during the second movement of the ink-jet head 1.

Accordingly, the image printing can be performed with high image-quality even when ink jetting is carried out both during the first movement and during the second movement. In other words, printing with high image-quality at a high speed can be realized.

Further, the central axis points each of the jetting ports 40C and 40M are not same in location and the jetting ports 40C and 40M are mutually away and apart without any overlapping. Therefore, an area dimension of the area formed by overlapping the small dots 43C formed of ink droplets jetted from the jetting ports 40C and the small dots 43M formed of ink droplets jetted from the jetting ports 43M becomes small assuredly.

In addition, the following alignment is made for each of the individual ink-channel groups 21*a* such that the central axis point 41K of the jetting port 40K, the central axis point 41Y of the jetting port 40Y, the symmetric-center 42C of the two jetting ports 40C, and the symmetric-center 42M of the two jetting ports 40M are positioned on the line X extending in the CR direction, on the ink-jetting surface 1*a*. This improves axisymmetrical property with respect to the shape of the dot formed of a small dot 43Y, small dots 43C, and small dots 43M, thereby improving the printing image-quality.

Further, the distance yc between the central axis points 41C of the two jetting ports 40C in the LF direction and the distance ym between the central axis points 41M of the two jetting ports 40M in the LF direction are equal to each other. Therefore, a width of the dot in the CR direction is made equal among the dots, thereby improving the printing image-quality.

Furthermore, the jetting ports 40C and 40M are formed such that when the symmetric-centers 42C and 42M of the jetting ports 40C and 40M respectively are shifted in the CR direction such that the symmetric-centers 42C and 42M are coincident with each other on the ink-jetting surface la, then a line connecting the central axis points 41C of the two jetting ports 40C and a line connecting the central axis points 41M of the two jetting ports 40M are extended in a direction in which the lines are orthogonal to each other. In addition, the central axis points of the jetting ports 40C and 40M are located at positions mutually different, and the jetting ports 40C and 40M do not overlap and are separated and away from each other. With this, an area dimension of the area formed by overlapping the small dots 43C formed of ink droplets jetted from the jetting ports 40C and the small dots 43M formed of ink droplets jetted from the jetting ports 43M becomes small assuredly.

Moreover, when the jetting ports 40Y, each formed in one of the individual ink channels 21Y which communicate with the manifold 17Y on the ink-jetting surface 1*a*, are moved in parallel such that the centroids of the jetting ports 40Y overlap one another, then the central axis points of the jetting ports 40Y are located at a same position with respect to all of the individual ink channels 21Y. Therefore, the shapes of the small dots 43Y jetted from the jetting ports 40Y do not vary greatly. The same is true with the jetting ports 40C and 40M formed in the individual ink channels 21C and 21M which communicate with manifolds 17C and 17M, respectively. Accordingly, the printing image-quality is further improved.

In addition, the opening areas of the jetting ports 40K, 40Y, 40C, and 40M are determined such that ink-jetting speeds become same among the inks jetted from the jetting ports 40K, 40Y, 40C, and 40M, respectively. Accordingly, landing accuracy by the ink droplets becomes satisfactory, thereby improving the printing image-quality.

Figure 8:
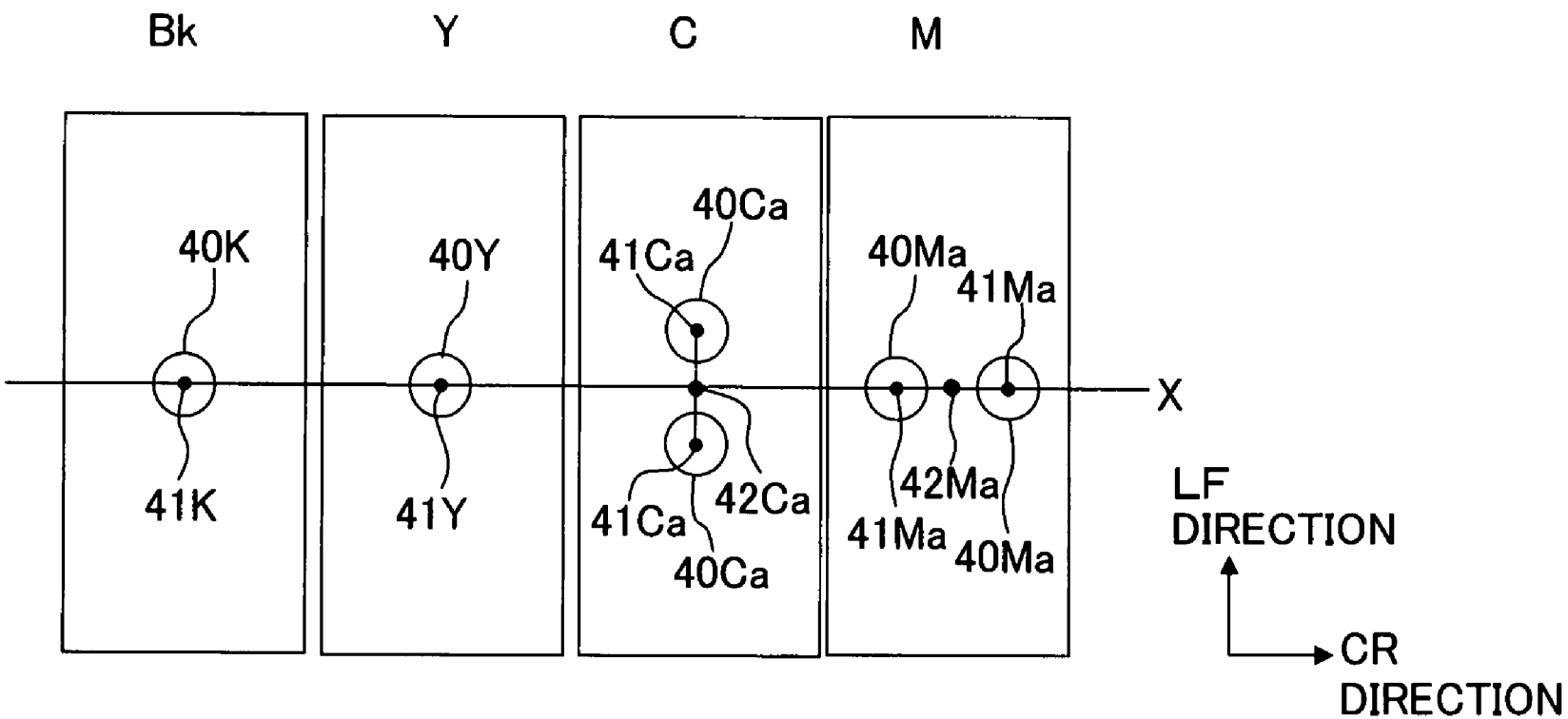
FIG. 8 is a diagram showing a modification of a positional relationship, among the jetting ports in an individual ink-channel group, on the ink-jetting surface shown in FIG. 1.

In this embodiment, the central axis points 41C of the two jetting ports 40C are located on the line inclined by 45 degrees counterclockwise with respect to the line X, and the central axis points 41M of the two jetting ports 40M are located on the line inclined by 45 degrees clockwise with respect to the line X. The symmetric-centers of these jetting ports, however, may be formed on lines each of which has an arbitrary angle with respect to the line X. For example, as shown in FIG. 8, jetting ports 40Ca and 40Ma may be formed such that the central axis points of the two jetting ports 40Ca are located on a line perpendicular to the line X, and the central axis points of the two jetting ports 40Ma are located on the line X.

Next, an explanation will be given as to modifications in each of which various changes are made to the embodiment. Any part or component of the modification, which is same in construction as those in the embodiment described above, will be assigned with a same reference numeral and any explanation therefor will be omitted as appropriate.

First Modification

Figure 9B:
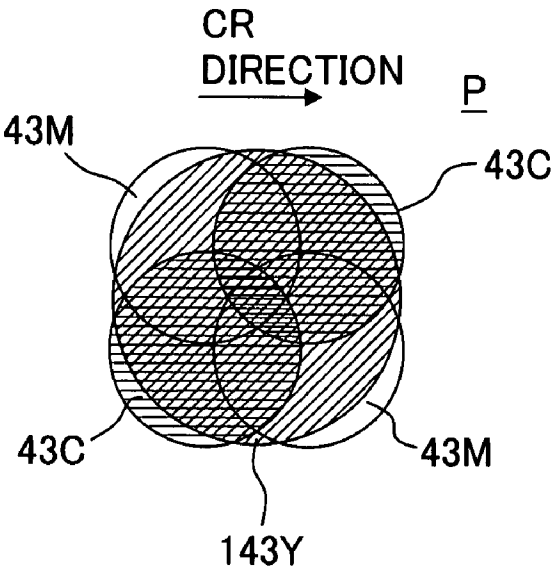
FIG. 9B is a diagram showing a state in which dots are formed onto the recording paper when ink droplets are jetted from the jetting ports in the individual ink-channel group shown in FIG. 9A.
Figure 9A:
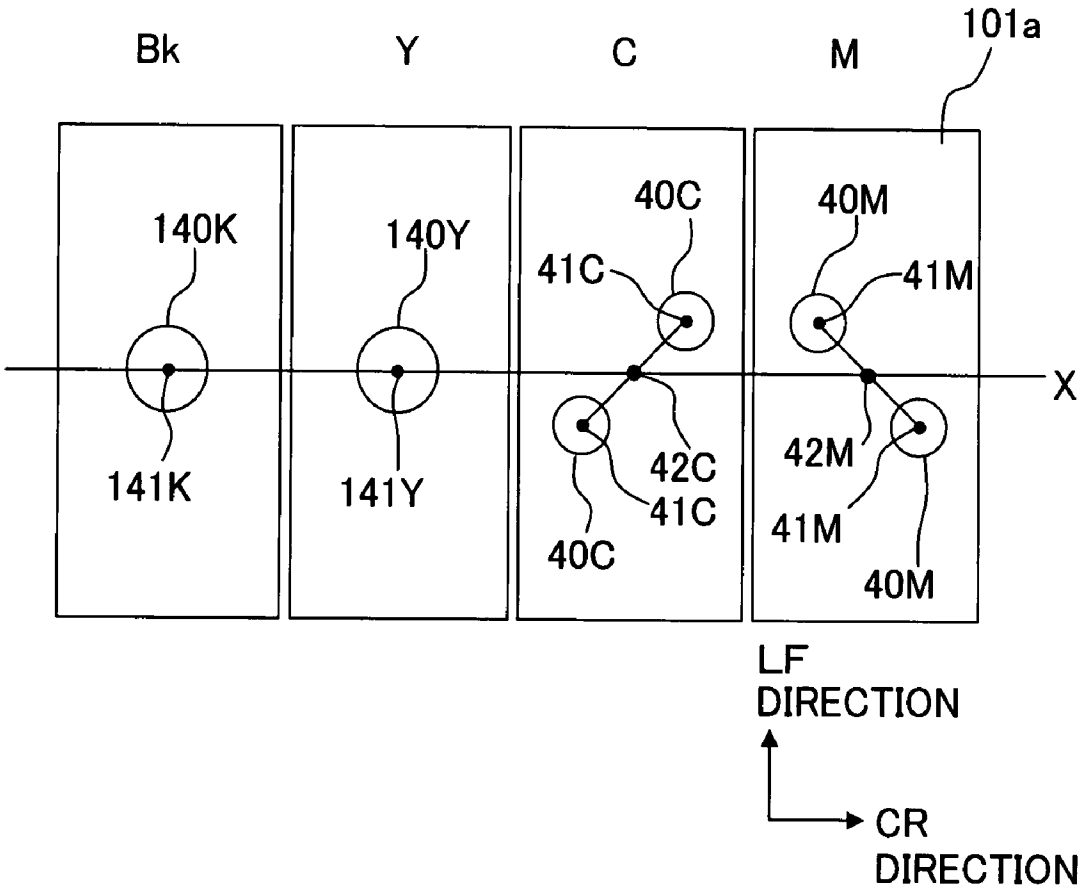
FIG. 9A is a diagram showing a positional relationship, among the jetting ports associated with an individual ink-channel group, on the ink-jetting surface of an ink-jet head in a first modification.

FIG. 9A is a diagram showing a positional relationship among the jetting ports 140K, 140Y, 40C, and 40M, associated with one of the individual ink-channel groups, on an ink-jetting surface 101*a* of an ink-jet head according to a first modification. Note that FIG. 9A is a diagram viewed from a position above the ink-jetting surface 101*a* in a state in which rectangular areas, which are on the ink-jetting surface 101*a* and at each of which one of the jetting ports 140K, 140Y, 40C, and 40M is formed, are shifted in the CR direction such that the rectangular areas are adjacent to one another. FIG. 9B is a diagram showing a state of the dots formed on the recording paper P when ink droplets are jetted from the jetting ports 140Y, 40C, and 40M in a certain individual ink channel group among the individual ink channel groups. As shown in FIG. 9A, an opening area dimension of each of the jetting ports 140K and 140Y, a total opening area of the two jetting ports 40C, and a total opening area dimension of the two jetting ports 40M are same one another.

Therefore, as shown in FIG. 9B, an area dimension of the small dot 143Y formed of an ink droplet jetted from the jetting port 140Y, a total area dimension of two small dots 43C formed of ink droplets jetted from the jetting port 40C, and a total area dimension of two small dots 43M formed of ink droplets jetted from the jetting port 40M are same one another. This uniformizes the volume of ink droplets among the respective colors, thereby improving the printing image-quality.

Second Modification

Figure 10A:
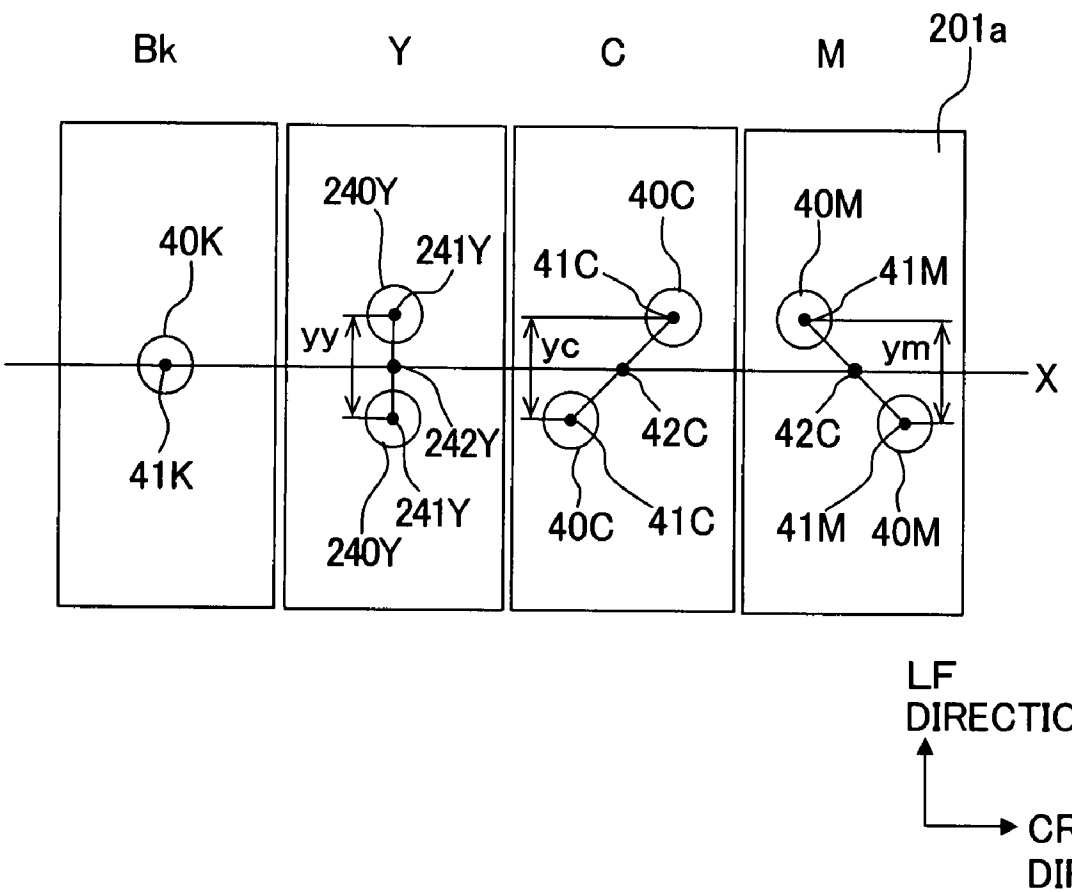
FIG. 10A is a diagram showing a positional relationship, among the jetting ports associated with an individual ink-channel group, on the ink-jetting surface of an ink-jet head in a first example of a second modification.
Figure 10B:
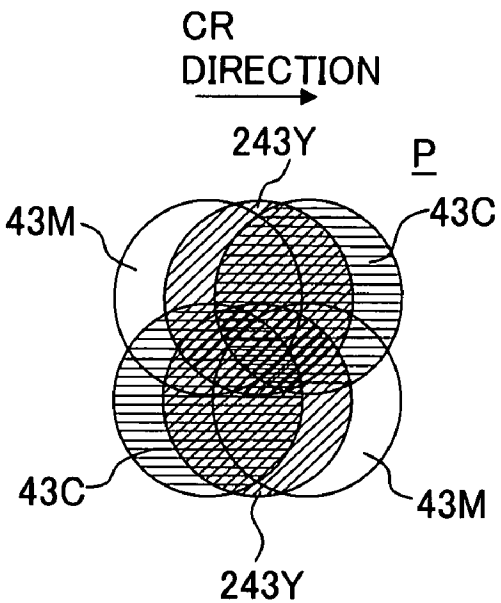
FIG. 10B is a diagram showing a state in which dots are formed on the recording paper when ink droplets are jetted from the jetting ports in the individual ink-channel group shown in FIG. 10A.

Next, an explanation will be given about a second modification of the ink-jet head by several examples. As a first example, FIG. 10A is a diagram showing a positional relationship among the jetting ports 40K, 240Y, 40C, and 40M, associated with one of the individual ink-channel groups, on an ink-jetting surface 201*a* of an ink-jet head according to the second modification. Note that FIG. 10A is a diagram viewed from a position above the ink-jetting surface 201*a* in a state in which rectangular areas which are on the ink-jetting surface 201*a* and at each of which one of the jetting ports 40K, 240Y, 40C, and 40M is formed, are shifted in the CR direction such that the rectangular areas are adjacent to one another. FIG. 10B is a diagram showing a state of the dots formed on the recording paper P when ink droplets are jetted from the jetting ports 240Y, 40C, and 40M in a certain individual ink channel group among the individual ink channel groups. As shown in FIG. 10A, two jetting ports 240Y are formed in each of the individual ink channels 21Y. The following alignment is made on the ink-jetting surface 201*a* so that the central axis point 41K of the jetting port 40K, the symmetric-center 242Y of the two jetting ports 240Y, the symmetric-center 42C of the two jetting ports 40C, and the symmetric-center 42M of the two jetting ports 40M are positioned on a line X extending in the CR direction. Moreover, the central axis points of the two jetting ports 240Y are located on a line perpendicular to the line X at an equal distance from the symmetric-center 242Y. With this, when the jetting ports 240Y, 40C, and 40M are shifted in the CR direction on the ink-jetting surface 201*a* such that the symmetric-centers 242Y, 42C, and 42M are coincident with one another, then the central axis points 241Y, 41C, and 41M of the jetting ports 240Y, 40C, and 40M respectively, are located at different positions. In other words, any ones of the jetting ports 240Y, 40C, and 40M do not share a same central axis point. Moreover, the distance yy between the central axis points 241Y of the two jetting ports 240Y in the LF direction, the distance yc between the central axis points 41C of the two jetting ports 40C in the LF direction, and the distance ym between the central axis points 41M of the two jetting ports 40M in the LF direction are same among one another.

As shown in FIG. 10B, the symmetric-center of the two small dots 243Y formed of ink droplets jetted from the two jetting ports 240Y, the symmetric-center of the two small dots 43C formed of ink droplets jetted from the two jetting ports 40C, and the symmetric-center of the two small dots 43M formed of ink droplets jetted from the two jetting ports 40M are coincident with one another. However, the centers of the two small dots 243Y, the centers of the two small dots 43C, and the centers of the two small dots 43M are away from one another.

This makes an areal dimension of an area, in which the small dots 43C and the small dots 43M overlap one another, to be small, thereby improving the printing image-quality. Moreover, the distance yy between the central axis points 241Y of the two jetting ports 240Y in the LF direction, the distance yc between the central axis points 41C of the two jetting ports 40C in the LF direction, and the distance ym between the central axis points 41M of the two jetting ports 40M in the LF direction are same one another. Accordingly, the widths of the dots in the CR direction are made uniform among the dots, thereby improving the printing image-quality.

In the first example, the central axis points 241Y of the two jetting ports 240Y are located on the line orthogonal to the line X; the central axis points 41C of the two jetting ports 40C are located on a line inclined by 45 degrees counterclockwise with respect to the line X; and the central axis points 41M of the two jetting ports 40M are located on a line inclined by 45 degrees clockwise with respect to the line X. However, the symmetric-centers of these jetting ports may be located on a line which has an arbitrary angle with respect to the line X.

Figure 11A:
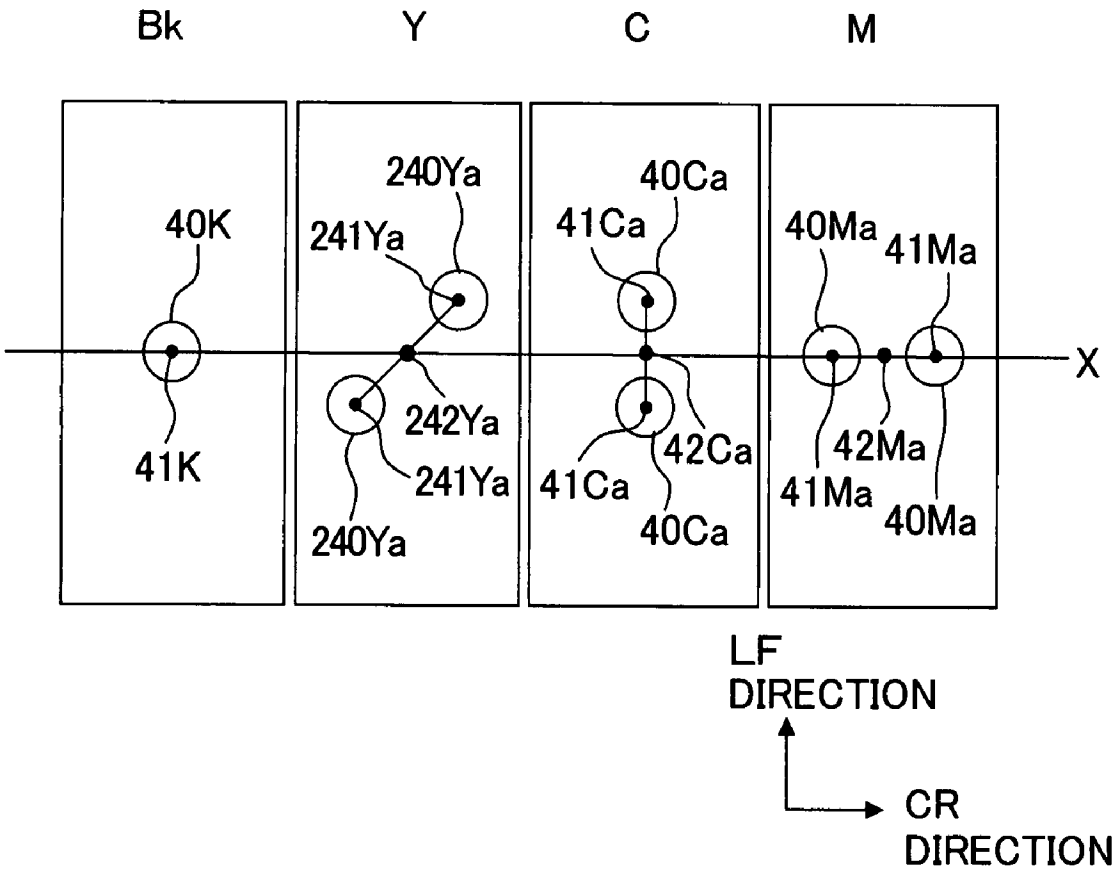
FIG. 11A is a diagram showing a positional relationship, among the jetting ports associated with an individual ink-channel group, on the ink-jetting surface of an ink-jet head in a second example of the second modification.
Figure 11B:
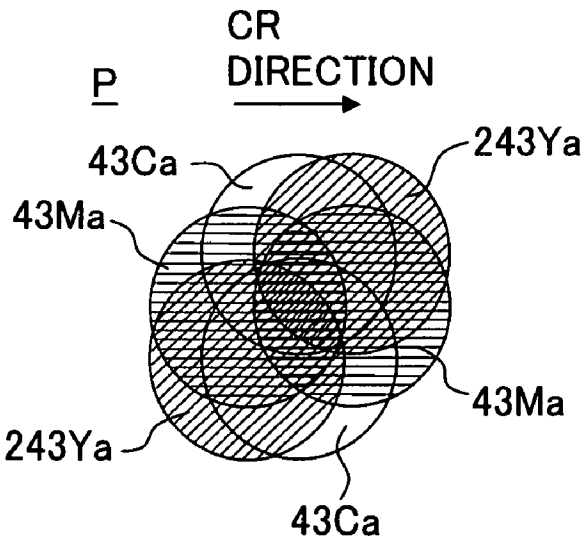
FIG. 11B is a diagram showing a state in which dots are formed on the recording paper when ink droplets are jetted from the jetting ports in the individual ink-channel group shown in FIG. 11A.

For example, as shown in FIG. 11A as a second example, central axis points 241Ya of two jetting ports 240Ya may be located on a line inclined by 45 degrees counterclockwise with respect to the line X at an equal distance from a symmetric-center 242Ya; central axis points 41Ca of two jetting ports 40Ca may be located on a line orthogonal to the line X at an equal distance from a symmetric-center 42Ca; and central axis points 41Ma of two jetting ports 40Ma may be located on the line X at an equal distance from a symmetric-center 42Ma. In this case also, when the jetting ports 240Ya, 40Ca, and 40Ma are shifted in the CR direction on the ink-jetting surface such that the symmetric-centers 242Ya, 42Ca, and 42Ma are coincident with one another, then the central axis points 241Ya, 41Ca, and 41Ma of the jetting points 240Ya, 40Ca, and 40Ma respectively are located at different positions. In other words, any ones of the jetting ports 240Ya, 40Ca, and 40Ma do not share a same central axis point. As shown in FIG. 11B, the centers of the two small dots 243Ya, the centers of the two small dots 43Ca, and the centers of the two small dots 43Ma are away from one another.

Figure 12B:
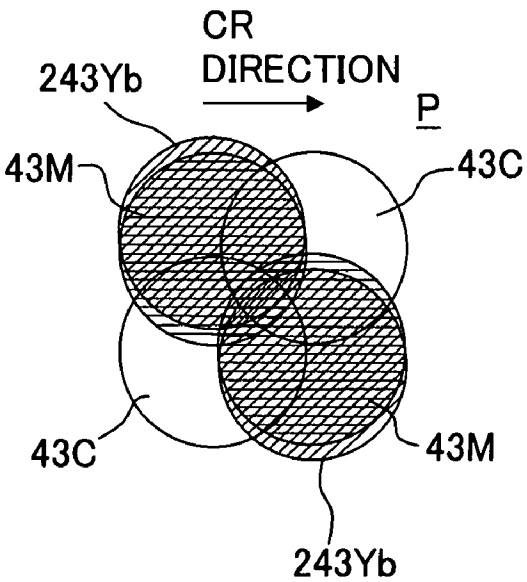
FIG. 12B is a diagram showing a state in which dots are formed on the recording paper when ink droplets are jetted from the jetting ports in the individual ink-channel group shown in FIG. 12A.
Figure 12A:
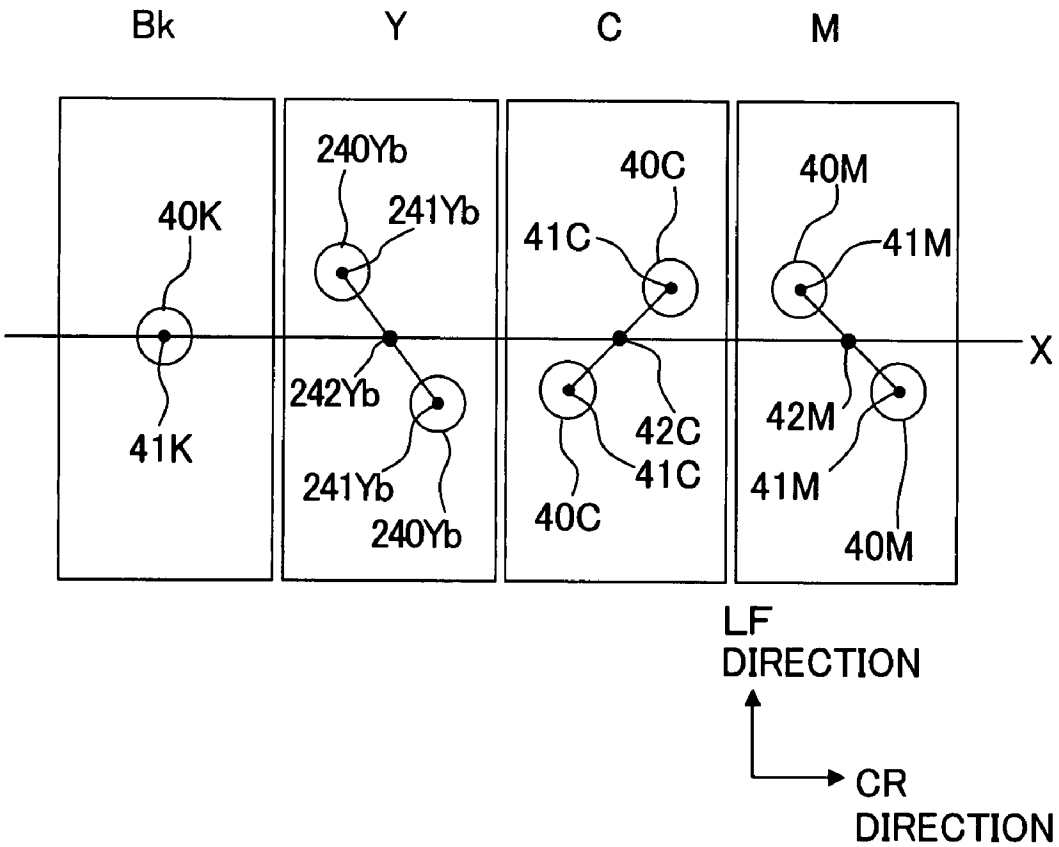
FIG. 12A is a diagram showing a positional relationship, among the jetting ports associated with an individual ink-channel group, on the ink-jetting surface of an ink-jet head in a third example of the second modification.

As shown in FIG. 12A as a third example, central axis points 241Yb of two jetting ports 240Yb may be located on a line inclined by 45 degrees clockwise with respect to the line X at an equal distance from a symmetric-center 242Yb; central axis points 41C of two jetting ports 40C may be located on a line inclined by 45 degrees counterclockwise with respect to the line X at an equal distance from a symmetric-center 42C; and central axis points 41M of two jetting ports 40M may be located on a line inclined by 45 degrees clockwise with respect to the line X at an equal distance from a symmetric-center 42M. In other words, when the jetting ports 240Yb, 40C, and 40M are shifted in the CR direction on the ink-jetting surface such that the symmetric-centers 242Yb, 42C, and 42M of the jetting ports 240Yb, 40C, and 40M are coincident with one another, then the central axis points of the jetting ports 240Yb and the central axis points of the jetting ports 40M are located at the same position. In this case, as shown in FIG. 12B, an areal dimension of an area in which the small dots 243Yb and the small dots 43C overlap becomes small.

Figure 13:
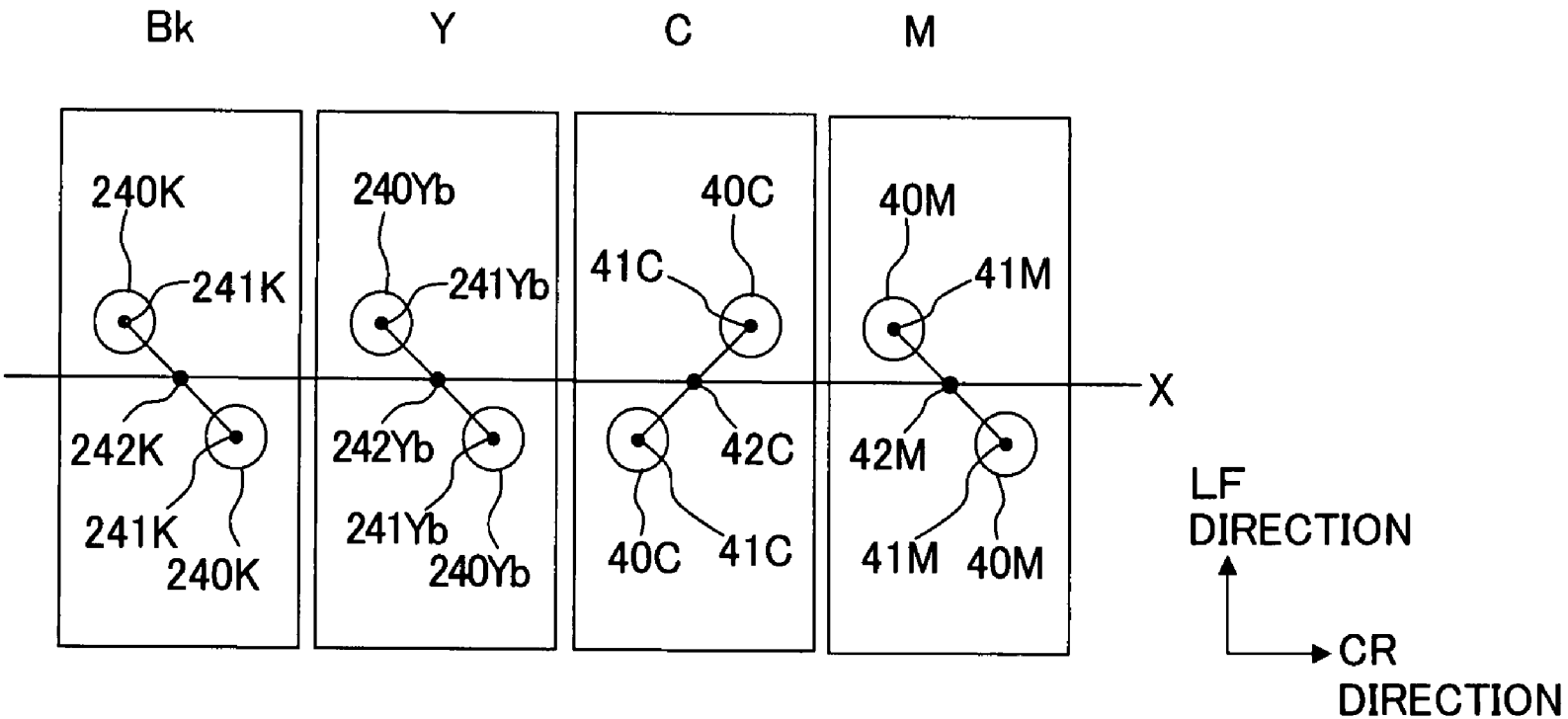
FIG. 13 is a diagram showing a positional relationship, among the jetting ports associated with an individual ink-channel group, on an ink-jetting surface of an ink-jet head in a forth example of the second modification.

Further, as shown in FIG. 13 as a forth example, two jetting ports 240K may be formed in each of the individual ink channels 21K for the black ink, and the central axis points of the two jetting ports 240K may be located on a line inclined by 45 degrees clockwise with respect to a line X. In this case, two jetting ports are formed for each of the individual ink channels formed in the channel unit.

Third Modification

Figure 14B:
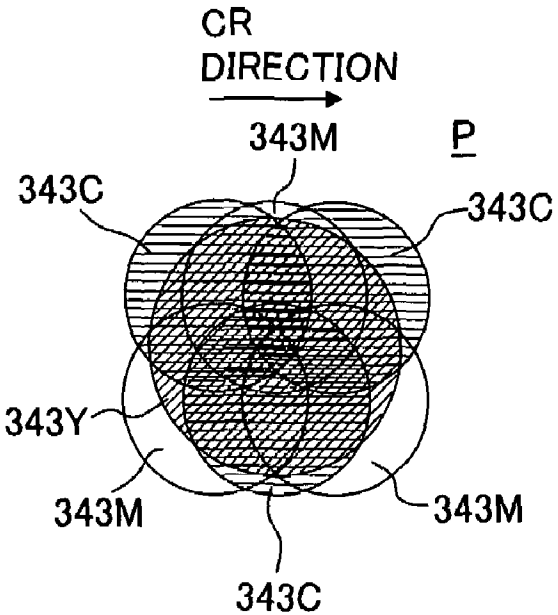
FIG. 14B is a diagram showing a state in which dots are formed on the recording paper when ink droplets are jetted from the jetting ports in the individual ink-channel group shown in FIG. 14A.
Figure 14A:
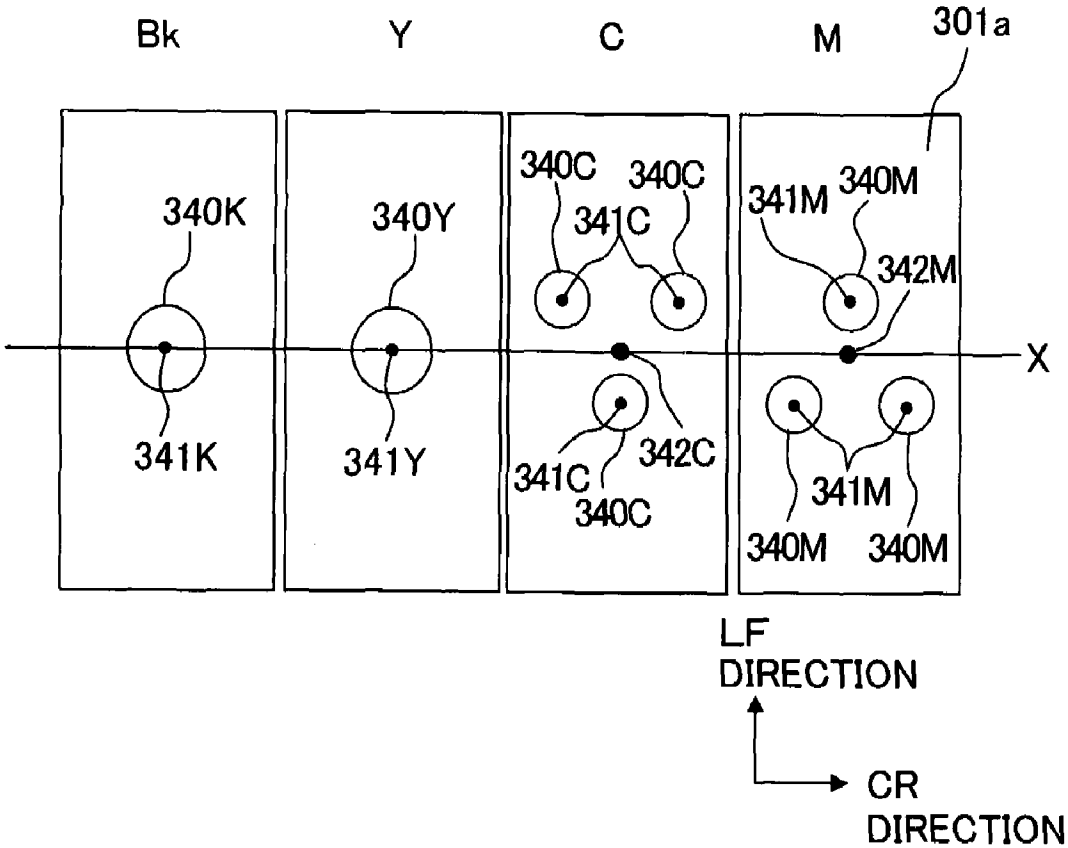
FIG. 14A is a diagram showing a positional relationship, among the jetting ports associated with an individual ink-channel group, on an ink-jetting surface of an ink-jet head in a first example of a third modification.

FIG. 14A is a diagram showing a positional relationship among jetting ports 340K, 340Y, 340C, and 340M, in a certain individual ink channel group among the individual ink channel groups, on an ink-jetting surface 301A of an ink-jet head according to a third modification. Note that FIG. 14A is a diagram viewed from a position above rectangular areas, which are on an ink-jetting surface 301*a* and at each of which one of the jetting ports 340K, 340Y, 340C, and 340M is formed, in a state that the rectangular areas are shifted in the CR direction such that the areas are adjacent to one another. FIG. 14B is a diagram showing a state of the dots formed on the recording paper P when ink droplets are jetted from the jetting ports 340Y, 340C, and 340M respectively, in a certain individual ink channel group among the individual ink channel groups. In the certain individual ink channel group, as shown in FIG. 14A, three jetting ports 340C are formed in an individual ink channel 21C, and three jetting ports 340M are formed in an individual ink channel 21M. Further, each of opening area dimensions of the jetting ports 340K and 340Y, a total opening area dimension of the three jetting ports 340C, and a total opening area dimension of the three jetting ports 340M are same one another.

In addition, the following arrangement is made on the ink-jetting surface 201*a* so that a central axis point 341K of the jetting port 340K, a central axis point 341Y of the jetting port 340Y, a symmetric-center 342C of the three jetting ports 340C, and a symmetric-center 342M of the three jetting ports 340M are positioned on a line X extending in the CR direction. Note that the term "symmetric-center" referred to in this modification means a point located at an equal distance from the three jetting ports on the ink-jetting surface 301*a*. Moreover, the central axis points 341C of the three jetting ports 340C and the central axis points 341M of the three jetting ports 340M are located at positions corresponding to apexes of two equilateral triangles respectively, which are rotated by 180 degrees with respect to each other. One of the sides of each of the triangles extends in the CR direction. In this case, when the jetting ports 340C and 340M are shifted in the CR direction on the ink-jetting surface 301A such that the symmetric-centers 342C and 342M are coincident with each other, then the central axis points 341C of the jetting ports 340C and the central axis points 341M of the jetting ports 340M are located at different positions. In other words, the jetting ports 340C and 340M do not share a same central axis point. Further, as shown in FIG. 14B, the center of the small dot 343Y, the centers of the three small dots 343C, and the centers of the three small dots 343M are apart from one another.

Accordingly, the areal dimension of an area in which the small dot 343Y, the small dots 343C, and the small dots 343M overlap one another becomes small, and thus the shape of the dots becomes close to a circular form, thereby assuredly improving the printing image-quality.

Figure 15A:
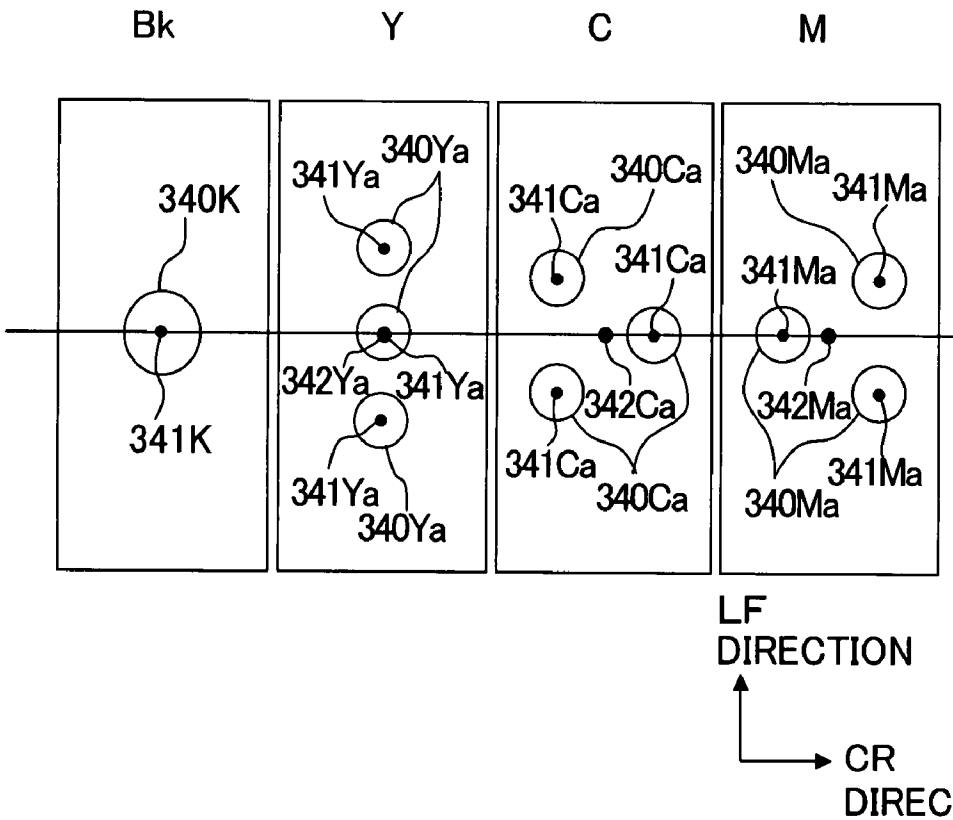
FIG. 15A is a diagram showing a positional relationship, among the jetting ports associated with an individual ink-channel group, on an ink-jetting surface of an ink-jet head in a second example of the third modification.

In this modification, the jetting port 340Y is formed in each of the individual ink channels 21Y in one of the individual ink-channel groups. However, a plurality of jetting ports may be formed in each of the individual ink channels 21Y. As shown in FIG. 15A as a second example, three jetting ports 340Ya aligned in the LF direction may be formed in each of the individual ink channels 21Y. At this time, it is preferable that the central axis points of three jetting ports 340Ca and the central axis points of three jetting ports 340Ma are located at positions corresponding to the apexes of two equilateral triangles respectively, which are rotated by 180 degrees with respect to each other, and that one of the sides of each of the equilateral triangles is extending in the LF direction. In this case, when the jetting ports 340Ya, 340Ca, and 340Ma are shifted in the CR direction on the ink-jetting surface such that the symmetric-centers 342Ya, 342Ca, and 342Ma are coincident with one another, then central axis points 341Ya, 341Ca, and 341Ma of the jetting ports 340Ya, 340Ca, and 340Ma respectively are located at different positions. In other words, any ones of the jetting ports 340Ya, 340Ca, and 340Ma do not share a same central axis point.

Figure 15B:
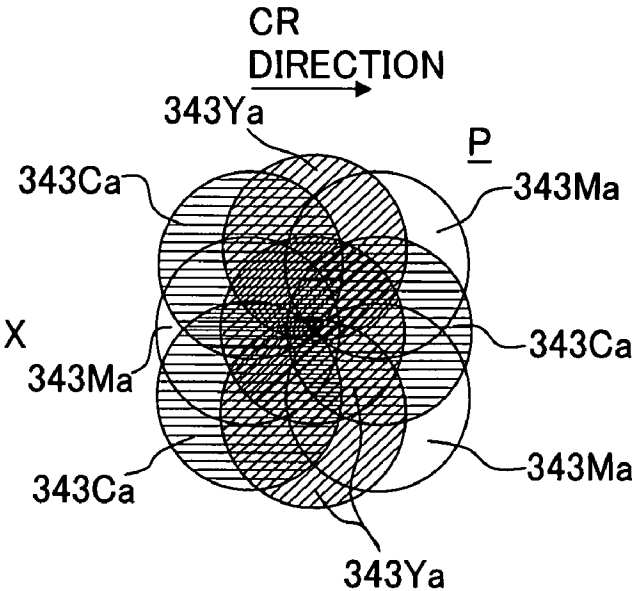
FIG. 15B is a diagram showing a state in which dots are formed on the recording paper when ink droplets are jetted from the jetting ports in the individual ink-channel group shown in FIG. 15A.

Accordingly, as shown in FIG. 15B, the areal dimension of an area in which the three small dots 343Ya, the three small dots 343Ca, and the three small dots 343Ma overlap one another becomes small, thereby improving the printing image-quality.

Second Embodiment

Figure 16:
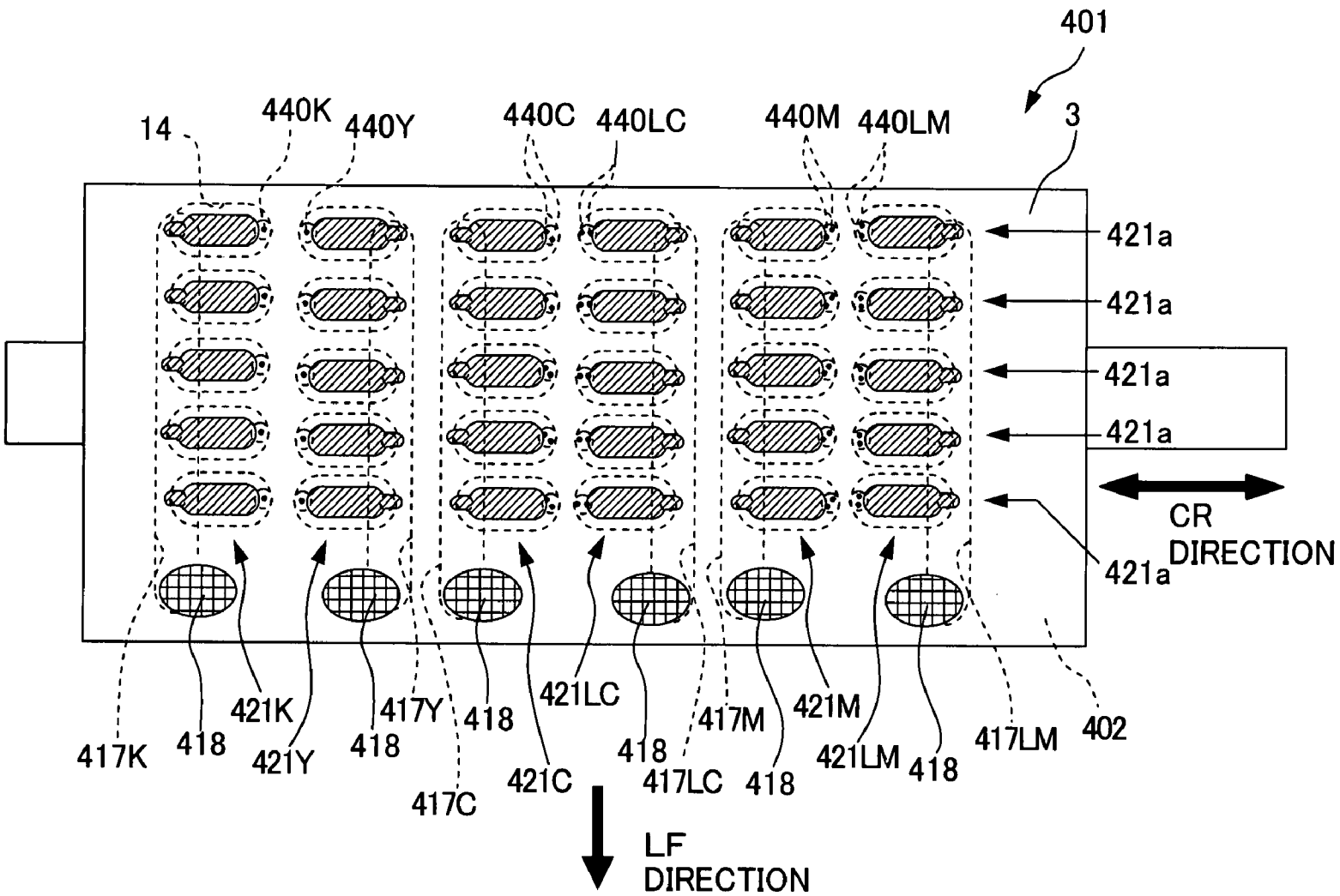
FIG. 16 is a plan view of an ink-jet head according to a second embodiment of the present invention.

Next, a second embodiment of the present invention will be explained with reference to the diagrams. However, any part or component of the second embodiment, which is same in construction as those in the embodiment described above, will be assigned with a same reference numeral and any explanation therefor will be omitted as appropriate. FIG. 16 is a plan view of an ink-jet head 401 according to the second embodiment. The ink-jet head 401 is a serial-type ink-jet head which jets, onto the recording paper P, droplets of six color inks in total: black ink, yellow ink, cyan ink, light cyan ink, magenta ink, and light magenta ink. Moreover, as shown in FIG. 16, the ink-jet head 401 includes six manifolds 417K, 417Y, 417C, 417LC, 417M, and 417LM which are aligned in the CR direction and each of which extends in the LF direction; and a channel unit 402 in which the following individual ink channels are formed, namely: five individual ink channels 421K extending from the manifold 417K to jetting ports 440K, respectively; five individual ink channels 421Y extending from the manifold 417Y to jetting ports 440Y, respectively; five individual ink channels 421C each extending from the manifold 417C to two jetting ports 440C; five individual ink channels 421LC each extending from the manifold 417LC to two jetting ports 440LC; five individual ink channels 421M each extending from the manifold 417M to two jetting ports 440M; and five individual ink channels 421LM each extending from the manifold 417LM to two jetting ports 440LM. Further, the channel unit 402 is provided with five individual ink channel groups 421*a* formed by six individual ink channels 421K, 421Y, 421C, 421LC, 421M, and 421LM which are communicating with manifolds 417K, 417Y, 417C, 417LC, 417M, and 417LM, respectively. The six individual ink channels which form each of the individual ink channel groups 421*a* are aligned in the CR direction.

The different color inks are stored in the manifolds 417K, 417Y, 417LC, 417M, and 417LM, respectively. The black ink, yellow ink, cyan ink, light cyan ink, magenta ink, and light magenta ink are supplied, from ink tanks (unillustrated) each storing one of the color inks, to the manifolds 417K, 417Y, 417C, 417LC, 417M and 417LM via the ink supply ports 18, respectively.

Figure 17A:
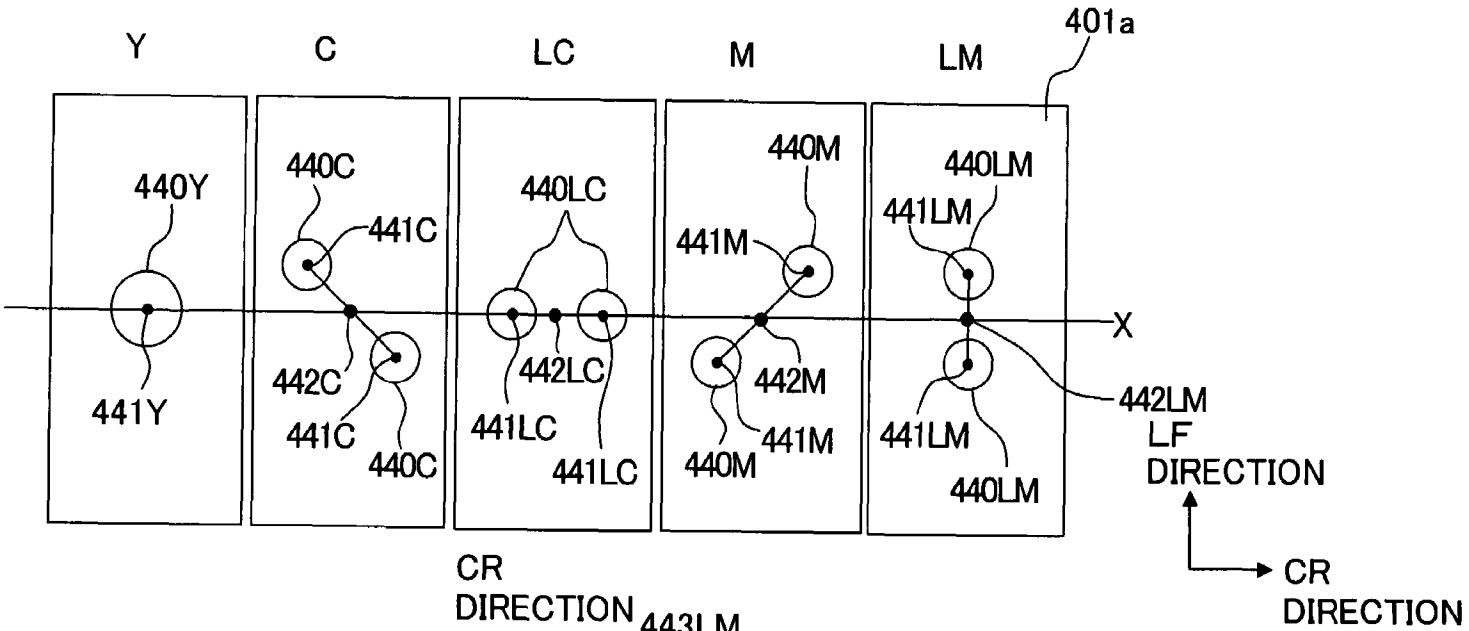
FIG. 17A is a diagram showing a positional relationship, among the jetting ports associated with an individual ink-channel group, on an ink-jetting surface of the ink jet head shown in FIG. 16.
Figure 17B:
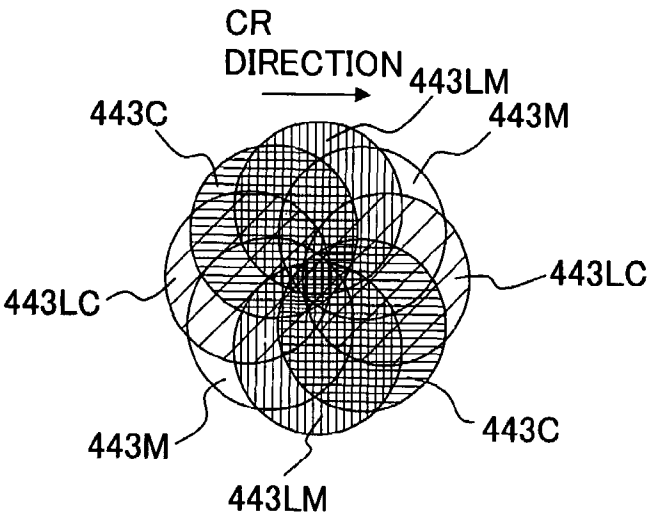
FIG. 17B is a diagram showing a state in which dots are formed on the recording paper when ink droplets are jetted from the jetting ports in the individual ink-channel group shown in FIG. 17A.
Figure 18:
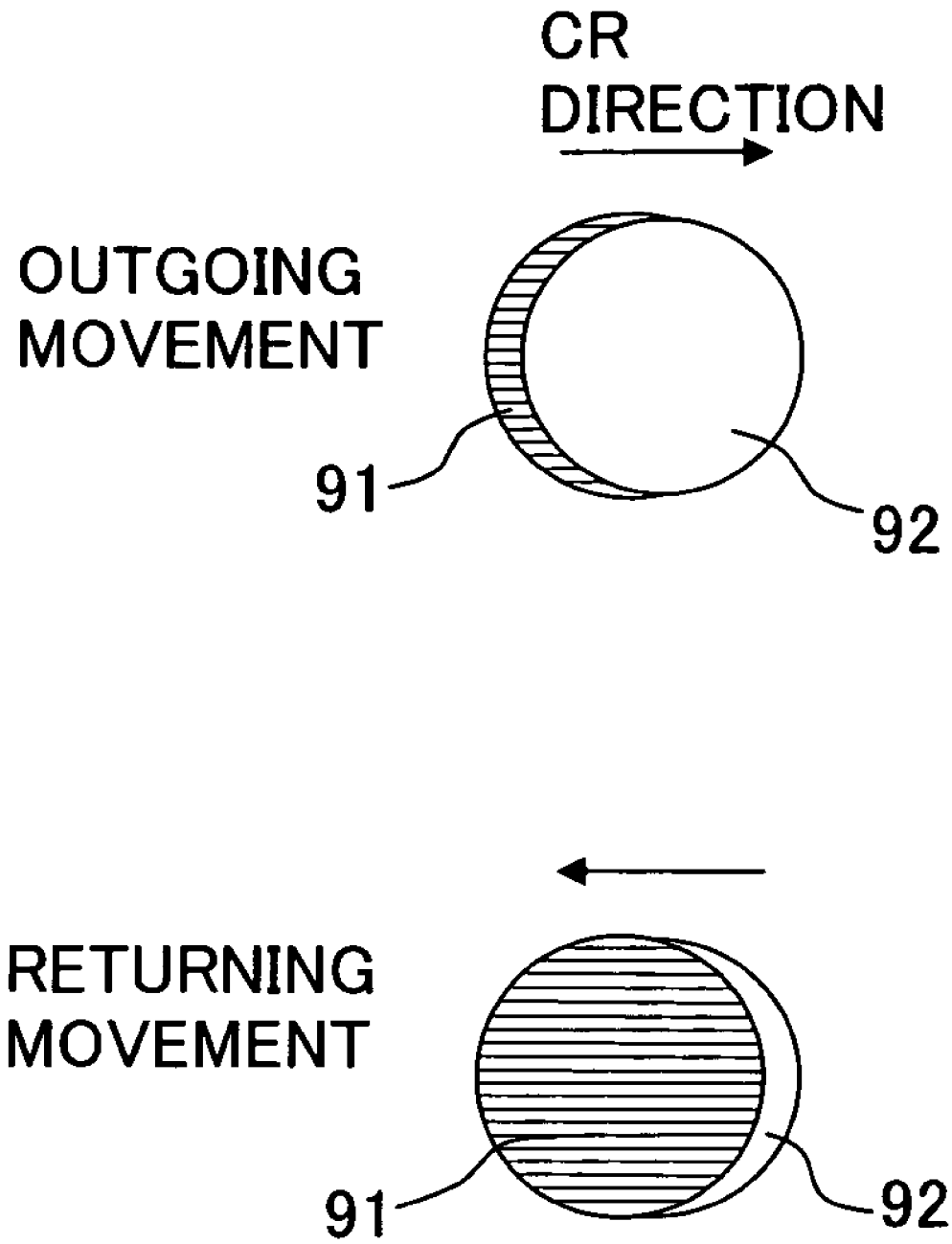
FIG. 18 is a diagram showing dots formed by a conventional ink-jet head.

Next, with reference to FIGS. 17A and 17B, an explanation will be given about a positional relationship among the jetting ports 440Y, 440C, 440LC, 440M, and 440LM in a certain individual ink channel group 421*a* on the ink-jetting surface 401*a*. FIG. 17A is a diagram showing the positional relationship among the jetting ports 440Y, 440C, 440LC, 440M, and 440LM in a certain individual ink channel group 421*a* on the ink-jetting surface 401*a*. Note that FIG. 17A is a conceptual diagram viewed from a position above the ink-jetting surface 401*a* in a state in which rectangular areas which are on the ink-jetting surface 401*a* and in which the jetting ports 440Y, 440C, 440LC, 440M, and 440LM are formed respectively are shifted in the CR direction such that the rectangular areas are adjacent to one another. FIG. 17B is a diagram showing a state of the dots formed on the recording paper P when ink droplets are jetted from the jetting ports 440Y, 440C, 440LC, 440M, and 440LM respectively, in the certain individual ink channel group 421*a*.

As shown in FIG. 17A, the following arrangement is made on the ink-jetting surface 401*a* so that a central axis point 441Y of the jetting port 440Y, a symmetric-center 442C of the two jetting ports 440C, a symmetric-center 442LC of the two jetting ports 440LC, a symmetric-center 442M of the two jetting ports 440M, a symmetric-center 442LM of the two jetting ports 440LC are located on a line X extending in the CR direction on the ink-jetting surface 401*a*. In addition, central axis points 441C of the two jetting ports 440C are located on a line inclined by 45 degrees clockwise with respect to the line X, at positions by an equal distance from the symmetric-center 442C. Central axis points 441LC of the two jetting ports 440LC are located on the line X at positions by an equal distance from the symmetric-center 442LC. Central axis points 441M of the two jetting ports 440M are located on a line inclined by 45 degreed counterclockwise with respect to the line X, at positions by an equal distance from the symmetric-center 442M. Central axis points 441LM of the two jetting ports 440LM are located on a line orthogonal to the line X, at positions by an equal distance from the symmetric-center 442LM. In this case, when the jetting ports 440C, 440LC, 440M, and 440LM are shifted in the CR direction on the ink-jetting surface 401*a* such that the symmetric-centers 442C, 442LC, 442M, and 442LM are coincident with one another, then the central axis points 441C, 441LC, 441M, and 441LM of the jetting ports 440C, 440LC, 440M, and 440LM respectively are located at different positions. In other words, any ones of jetting ports 440C, 440LC, 440M, and 440LC do not share a same central axis point. Further, an opening area dimension of the jetting port 440Y, a total opening area dimension of the two jetting ports 440C, a total opening area dimension of the two jetting ports 440LC, a total opening area dimension of the two jetting ports 440M, and a total opening area dimension of the two jetting ports 440LM are same one another.

In addition, as shown in FIG. 17B, the small dots 443Y, 443C, 443LC, 443M, and 443LM formed of the ink droplets jetted from the jetting ports 440Y, 440C, 440LC, 440M, and 440LM respectively are mutually different in the location of the center thereof.

In this case, the central axis points 441C, 441LC, 441M, and 441LM of the jetting ports 440C, 440LC, 440M, and 440LM respectively, in one of the individual ink-channel groups 421*a*, are mutually different in location thereof. Therefore, the area dimension of an area in which the small dots 443C, 443LC, 443M, and 443LM overlap becomes small. Further, the opening area dimension of the jetting port 440Y, the total opening area dimension of the two jetting ports 440C, the total opening area dimension of the two jetting ports 440LC, the total opening area dimension of the two jetting ports 440M, and the total opening area dimension of the two jetting ports 440LM are same one another. Accordingly, the volume of ink droplet is made equal among the color inks, thereby improving the printing image-quality.

The exemplary embodiments of the present invention have been explained above. However, the present invention is not limited to these embodiments, and it is possible to make various design modifications to the embodiments within the scope defined by the claims. For example, in the above-described first embodiment, with respect to one of the individual ink-channel groups 21*a*, the central axis point 41K of the jetting port 40K, the central axis point 41Y of the jetting port 40Y, the symmetric-center 42C of the two jetting ports 40C, and the symmetric-center 42M of the two jetting ports 40M are located on the line X extending in the CR direction. However, it is allowable that the central axis points of these jetting ports or the symmetric-centers of these multiple jetting ports are not located on the line X.

Moreover, in the first embodiment, two jetting ports 40C are formed for each of the individual ink channels 21C communicating with the manifold 17C, and when the symmetric-centers 42C of these jetting ports 40C are moved in parallel such that the symmetric-centers 42C overlap one another, then the jetting ports 40C in all the individual ink channels 21C are consequently located at a same position. The same is true with the jetting ports 40M two of which are formed in each of the individual ink channels 21M communicating with the manifold 17M. In this way, even in a case in which the jetting ports 40C and 40M are moved in parallel, it is allowable that the central axis points of the jetting ports are not located at a same position.

Further, in the first embodiment, two jetting ports 40C and two jetting ports 40Y are formed in the individual ink channels 21C and 21M, respectively. In the third modification according to the first embodiment, there is provided a structure in which the three jetting ports 340C and the three jetting ports 340Y are formed in the individual ink channels, respectively. The ink-jet head of the present invention, however, is not limited to these structures, and it is allowable that not less than four jetting ports are formed in each of the individual ink channels.

Furthermore, in the first embodiment, the ink-jet head 1 is capable of jetting droplets of four color inks. In the second embodiment, the ink-jet head 401 is capable of jetting ink droplets of six color inks. The ink-jet head of the present invention is not limited to these embodiments, and it is allowable that the ink-jet head is capable of jetting droplets of not less than three color inks or of not less than seven color inks (two or six color inks except for the black ink).

In addition, in the first embodiment, the individual ink channel 21C and the individual ink channel 21M have two jetting ports 40C and two jetting ports 40M, respectively. Also, when the jetting ports 40C and 40M are shifted in the CR direction on the ink-jetting surface la such that the symmetric-centers 42C and 42M are coincident with each other, then the central axis points 41Y, 41C, and 41M of the jetting ports 40Y, 40C, and 40M respectively are located at different positions. In other words, any ones of the jetting ports 40Y, 40C, and 40M do not share a same central axis point. The ink-jet head of the present invention is not limited to this embodiment. It is allowable that the individual ink channels are different in number or quantity of jetting ports formed therein, and that the central axis points of the jetting ports are same in location.

By using the ink-jet head described in the embodiments and the modifications thereof as described above, it is possible to form a dot pattern having an area of a single color for each of the color inks, in a state in which the centroids of the dots of the different color inks are coincident with one another and in which the dots of the respective color inks do not completely overlap with one another, as shown in FIGS. 7, 9B, 10B, 11B, 12B, 14B, 15B, and 17B. By forming such a dot pattern as described above, it is possible to form dot patterns having nearly same color tint, regardless of the order in which the colors are overlapped.

What is claimed is:

1. An ink-jet head which jets a plurality of different color inks, the ink-jet head comprising:

a plurality of pressure chambers aligned in a first direction;

a plurality of ink chambers which communicate with the pressure chambers respectively and each of which stores one of the inks;

an ink-jetting surface on which a plurality of nozzle holes of nozzles are formed, the nozzles communicating with the pressure chambers respectively and including a plurality of multi-nozzles each of which has a plurality of nozzle holes; and a plurality of individual ink channels each of which communicates with one of the ink chambers, one of the pressure chambers, and one of the nozzles, wherein:

the nozzle holes of each of the multi-nozzles communicate with one of the individual ink channels;

symmetric-centers of the plurality of nozzles are arranged on the ink-jetting surface in a line extending in the first direction with at least two multi-nozzles having symmetric centers arranged in a line extending in the first direction; and wherein when the multi-nozzles are shifted in the first direction to make the symmetric-centers of the multi-nozzles mutually coincident, the multi-nozzles include at least two multi-nozzles which do not mutually overlap.

2. The ink-jet head according to claim 1, wherein the inks are inks other than a black ink; and a number of the ink chambers is not less than three.

3. The ink-jet head according to claim 2, wherein a plurality of pressure chamber-rows are formed by forming a plurality of pressure chamber-columns aligned in a second direction different from the first direction, each of the pressure chamber-columns including pressure chambers, among the pressure chambers, aligned in the first direction and each of the pressure chamber-rows including pressure chambers, among the pressure chambers, aligned in the second direction;

each of the ink chambers communicates with all pressure chambers included in one of the pressure chamber-columns; and pressure chambers, among the plurality of pressure chambers, communicating with one of the ink chambers are communicated with nozzles, among the plurality of nozzles, provided in a number same as that of the pressure chambers.

4. The ink-jet head according to claim 3, wherein the plurality of nozzles include a single nozzle formed with one nozzle hole, and a center of the single nozzle and symmetric-centers of the multi-nozzles are positioned on the line extending in the first direction.

5. The ink-jet head according to claim 3, wherein in each of the pressure chamber-columns, a maximum distance, between centers of the nozzle holes of each of the multi-nozzles, in a direction perpendicular to the first direction, is mutually equal among the multi-nozzles.

6. The ink-jet head according to claim 3, wherein when in each of the pressure chamber-columns, the multi-nozzles are shifted on the ink-jetting surface in to make symmetric-centers of the multi-nozzles mutually coincident, the multi-nozzles in each of the pressure chamber-columns include not less than two multi-nozzles which do not mutually overlap, and each of which is formed with nozzle holes in a mutually same number.

7. The ink-jet head according to claim 3, wherein when the multi-nozzles in each of the pressure chamber-columns are shifted on the ink-jetting surface in the first direction to make symmetric-centers of the multi-nozzles to be coincident, none of the multi-nozzles mutually overlaps, and each of the multi-nozzles is formed with the nozzle holes in a number same among the multi-nozzles.

8. The ink-jet head according to claim 7, wherein when in each of the pressure chamber-columns, the multi-nozzles are shifted on the ink-jetting surface in the first direction to make the symmetric-centers of the multi-nozzles to mutually coincide, nozzle holes of a multi-nozzle, among the multi-nozzles, are mutually separated from nozzle holes of another multi-nozzle without overlapping.

9. The ink-jet head according to claim 7, wherein two pieces of multi-nozzles are provided in each of the pressure chamber-columns; each of the two multi-nozzles is formed with two nozzle holes; and two lines, each connecting centers of the two nozzle holes of each of the two multi-nozzles, are extending in mutually orthogonal directions.

10. The ink-jet head according to claim 7, wherein two pieces of the multi-nozzles are provided in each of the pressure chamber-columns; each of the two multi-nozzles is formed with three nozzle holes; and centers of the three nozzle holes of one of the two multi-nozzles and centers of the three nozzle holes of the other of the two multi-nozzles are located at positions corresponding to apexes of two equilateral triangles respectively, which are rotated by 180 degrees from each other.

11. The ink-jet head according to claim 3, when nozzles, among the nozzles, communicating with individual ink channels are shifted on the ink-jetting surface to make symmetric-centers of the nozzles to be mutually coincident, centers of nozzle holes of the nozzles are mutually coincident.

12. The ink-jet head according to claim 3, wherein a total area dimension, of nozzle holes of nozzles, among the plurality of nozzles, communicating with pressure chambers included in each of the pressure chamber-columns, is mutually same among the nozzles.

13. The ink-jet head according to claim 3, ink-jetting speed, at each of which each of the inks is jetted from nozzles, among the nozzles, communicating with the pressure chambers included in one of the pressure chamber-columns is mutually same.

14. An ink-jet recording apparatus which performs recording by jetting a plurality of different color inks onto a recording medium, the apparatus comprising:

a transport unit which transports the recording medium in a predetermined transporting direction;

an ink-jet head, which jets the inks onto the recording medium while reciprocating in a direction perpendicular to the transporting direction, and which includes a plurality of pressure chambers aligned in a first direction, a plurality of ink chambers which communicate with the pressure chambers respectively and each of which stores one of the inks, and an ink-jetting surface in which a plurality of nozzles are formed, the plurality of nozzles communicating with the pressure chambers respectively, each formed with a nozzle hole, and including a plurality of multi-nozzles each of which is formed with a plurality of nozzle holes; and a plurality of individual ink channels each of which communicates with one of the ink chambers, one of the pressure chambers, and one of the nozzles; wherein the nozzle holes of each of the multi-nozzles communicate with one of the individual ink channels;

symmetric-centers of the nozzles are arranged on the ink-jetting surface in a line extending in the first direction with at least two multi-nozzles having symmetric centers arranged in a line extending in the first direction; and wherein when the multi-nozzles are shifted in the first direction to make the symmetric-centers of the multi-nozzles mutually coincident, the multi-nozzles include at least two multi-nozzles which do not mutually overlap.

15. The ink-jet recording apparatus according to claim 14, wherein the inks are inks other than a black ink; and a number of the ink chambers is not less than three.

16. The ink-jet recording apparatus according to claim 15, wherein a plurality of pressure chamber-columns aligned in a second direction different from the first direction are formed; each of the pressure chamber-columns includes pressure chambers, among the pressure chambers, aligned in the first direction; each of the ink chambers communicates with the pressure chambers included in a pressure chamber-column among all the pressure chamber-columns; and pressure chambers, among the plurality of pressure chambers, communicating with one of the ink chambers are communicated with nozzles, among the plurality of nozzles, which are provided in a number same as that of nozzles communicating with another ink chamber.

* * * * *